US011333052B2

(12) United States Patent
Iida

(10) Patent No.: US 11,333,052 B2
(45) Date of Patent: May 17, 2022

(54) COOLING DEVICE

(71) Applicant: DENSO CORPORATION, Kariya (JP)

(72) Inventor: Junya Iida, Kariya (JP)

(73) Assignee: DENSO CORPORATION, Kariya (JP)

( * ) Notice: Subject to any disclaimer, the term of this patent is extended or adjusted under 35 U.S.C. 154(b) by 148 days.

(21) Appl. No.: 16/788,558

(22) Filed: Feb. 12, 2020

(65) Prior Publication Data

US 2020/0263579 A1 Aug. 20, 2020

(30) Foreign Application Priority Data

Feb. 18, 2019 (JP) ..... JP2019-026883

(51) Int. Cl.

| | |
|---|---|
| ***F01N 3/02*** | (2006.01) |
| ***F01N 3/029*** | (2006.01) |
| ***F01N 3/20*** | (2006.01) |
| ***F01N 3/04*** | (2006.01) |

(52) U.S. Cl.

CPC ..... *F01N 3/0293* (2013.01); *F01N 3/04* (2013.01); *F01N 3/206* (2013.01); *F01N 2610/11* (2013.01); *F01N 2610/1453* (2013.01)

(58) Field of Classification Search

CPC ..... F01N 2610/02; F01N 2610/11; F01N 2610/1453; F01N 3/0293; F01N 3/04; F01N 3/206; F01N 3/2066; Y02A 50/20; Y02T 10/12

See application file for complete search history.

(56) References Cited

U.S. PATENT DOCUMENTS

| | | | | |
|---|---|---|---|---|
| 9,284,871 | B2 | 3/2016 | Knittel et al. | |
| 9,518,592 | B2 | 12/2016 | Wright et al. | |
| 2013/0228231 | A1* | 9/2013 | Nagel | F02M 53/043 137/334 |
| 2015/0027108 | A1* | 1/2015 | Winkler | F01N 3/208 60/295 |
| 2015/0059320 | A1* | 3/2015 | Winkler | F01N 3/208 60/295 |
| 2017/0363053 | A1 | 12/2017 | Ichihashi et al. | |

* cited by examiner

*Primary Examiner* — Phutthiwat Wongwian
*Assistant Examiner* — Diem T Tran
(74) *Attorney, Agent, or Firm* — Nixon & Vanderhye P.C.

(57) ABSTRACT

An injection valve is provided in a cooling device. An outer jacket is provided at an outside of the injection valve. A cylindrical partitioning unit divides an annular space into an outside passage on a side of the outer jacket and an inside passage on a side of the injection valve. A second pipe portion supplies cooling water into the annular space and a first pipe portion discharges the cooling water from the annular space. A first restricting portion is provided between the first pipe portion and the second pipe portion and it restricts a flow of the cooling water in the outside passage from a part on a side of the second pipe portion to a part on a side of the first pipe portion. A second restricting portion is provided at a position on a side of the first pipe portion opposite to an injection port. The second restricting portion restricts the flow of the cooling water between the outside and the inside passages. A communication passage is formed in the cylindrical partitioning unit at a position above the first restricting portion and it communicates the outside and the inside passages to each other.

15 Claims, 16 Drawing Sheets

COOLING DEVICE

CROSS REFERENCE TO RELATED APPLICATION

This application is based on Japanese Patent Application No. 2019-26883 filed on Feb. 18, 2019, the disclosure of which is incorporated herein by reference.

FIELD OF TECHNOLOGY

The present disclosure relates to a cooling device for an injection valve installed in a vehicle.

BACKGROUND

In a field of a diesel engine, a DPF (Diesel Particulate Filter) for collecting PM (Particulate Matter) contained in exhaust gas emitted from the diesel engine as well as an SCR (Selective Catalytic Reduction) system for purifying NOx (nitrogen oxide) contained in the exhaust gas is known in the art. An injection valve to be used for regenerating the DPF injects fuel (such as, light oil) into an exhaust pipe of a vehicle. An injection valve to be used in the SCR system injects reducing agent (such as, urea aqueous solution) into the exhaust pipe of the vehicle. Each of those injection valves is provided at a position neighboring to the diesel engine or provided in an engine room and the injection valve is used under a high-temperature circumstance. It is, therefore, necessary to provide a cooling device to cool down the injection valve and to protect them from a thermal damage.

The cooling device is generally installed in the vehicle in such a way that an axis of the cooling device is inclined with respect to a gravity direction. In addition, the cooling device installed in the vehicle is further inclined with respect to the gravity direction due to an inclination of the vehicle on a road. Air bubbles may enter the cooling water, which is supplied into an annular space of the cooling device. In such a case, the air bubbles may remain in an upper-side portion of the annular space. Then, cooling performance of the cooling device to the injection valve may be decreased.

In the cooling device which is inclined with respect to the gravity direction, a level of water surface in the annular space is changed depending on a position of connecting pipes connected to circumferential portions of a jacket of the cooling device. When the level of the water surface is lowered in the annular space depending on an installed condition of the cooling device in the vehicle, it may become difficult to effectively cool down the injection valve.

SUMMARY OF THE DISCLOSURE

The present disclosure is made in view of the above problem. It is an object of the present disclosure to provide a cooling device, which can increase a cooling performance to an injection valve.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
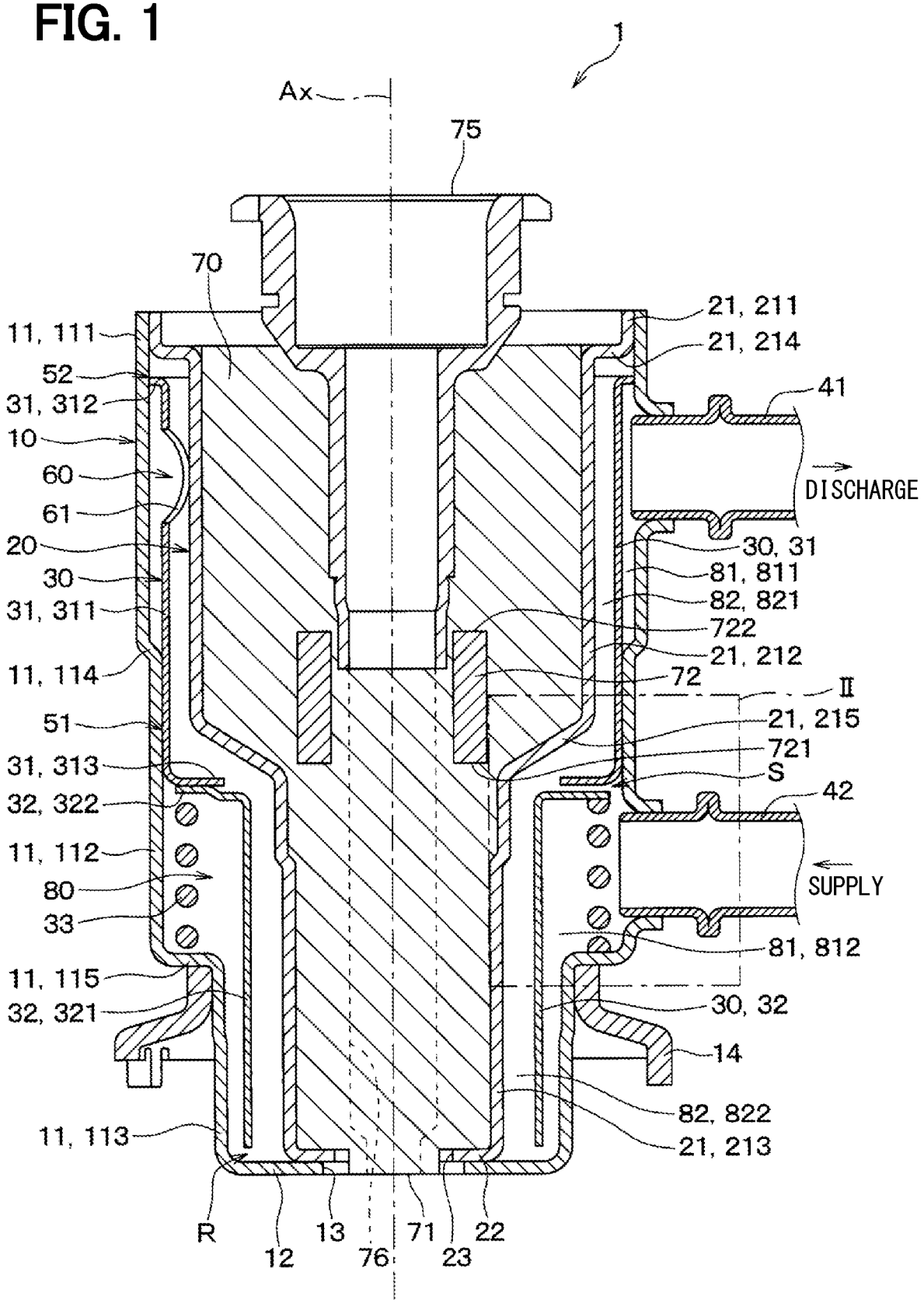
FIG. 1 is a schematic cross-sectional view showing a cooling device for an injection valve according to a first embodiment of the present disclosure.

The present disclosure will be explained hereinafter by way of multiple embodiments and/or modifications with reference to the drawings. The same reference numerals are given to the same or similar structures and/or portions in order to avoid repeated explanation.

First Embodiment

A cooling device 1 of a first embodiment will be explained with reference to the drawings. The cooling device 1 cools down by cooling water an injection valve installed in an automotive vehicle. The injection valve to be cooled down by the cooling device is composed of, for example, an injection valve to be used in an SCR (Selective Catalytic Reduction) system for purifying NOx (nitrogen dioxide) contained in exhaust gas emitted from a diesel engine, an injection valve for regenerating DPF (Diesel Particulate Filter) which traps PM (Particulate Material) contained in the exhaust gas, or the like. The injection valve used in the SCR system injects reducing agent, for example urea aqueous solution, into an exhaust pipe. The injection valve used for regenerating the DPF injects fuel, for example light oil, into the exhaust pipe. Those injection valves are located at a position of the exhaust pipe closer to an internal combustion engine (hereinafter, the engine) or at a position inside of an engine compartment. Therefore, those injection valves are generally used in a circumstance of high temperature. In such a case, a cooling device is provided for the injection valve in order to avoid a thermal damage in the injection valve, wherein the injection valve is cooled down by cooling water flowing through the cooling device.

A structure of the cooling device 1 will be explained. As shown in FIG. 1, the cooling device 1 includes an outer jacket 10, an inner jacket 20, a cylindrical partitioning unit 30, a first pipe portion 41, a second pipe portion 42, a first restricting portion 51, a second restricting portion 52, a communication passage 60 and so on. An injection valve 70 having an injection port 71 is provided in the cooling device 1. In the present disclosure, a lower side of the injection valve 70 is also referred to as an injection-port side, while an upper side of the injection valve 70 is also referred to as an injection-port opposite side.

The outer jacket 10 is formed in a cylindrical shape having a bottom portion. The outer jacket 10 has an outer casing 11 and an outer-side bottom portion 12, which is formed at an axial end of the outer casing 11 on the injection-port side. The outer casing 11 of the outer jacket 10 has such a shape, according to which a diameter of the outer casing 11 is changed in a step-wise manner in its axial direction. The outer casing 11 has an outer-side large-diameter portion 111, an outer-side middle-diameter portion 112, and an outer-side small-diameter portion 113, which are arranged in an axial-downward direction from the injection-port opposite side (the upper side) to the injection-port side (the lower side). The diameter of the outer-side middle diameter portion 112 is smaller than the diameter of the outer-side large-diameter portion 111. The diameter of the outer-side small-diameter portion 113 is smaller than the diameter of the outer-side middle-diameter portion 112. A first outer-side step portion 114 is formed in the outer casing 11 at a position between the outer-side large-diameter portion 111 and the outer-side middle-diameter portion 112. A second outer-side step portion 115 is formed in the outer casing 11 at a position between the outer-side middle-diameter portion 112 and the outer-side small-diameter portion 113. An outer-side through-hole 13 is formed in the outer-side bottom portion 12, so that a forward end of the injection valve 70 on the injection-port side is exposed to an outside of the cooling device 1 through the outer-side through-hole 13.

In a similar manner to the outer jacket 10, the inner jacket 20 is formed in a cylindrical shape having a bottom portion. The inner jacket 20 has an inner casing 21 and an inner-side bottom portion 22, which is formed at an axial end of the inner casing 21 on the injection-port side. The inner casing 21 of the inner jacket 20 has such a shape, according to which a diameter of the inner casing 21 is changed in a step-wise manner in its axial direction. The inner casing 21 has an inner-side large-diameter portion 211, an inner-side middle-diameter portion 212, and an inner-side small-diameter portion 213, which are arranged in the axial-downward direction from the injection-port opposite side (the upper side) to the injection-port side (the lower side). The diameter of the inner-side middle-diameter portion 212 is smaller than the diameter of the inner-side large-diameter portion 211. The diameter of the inner-side small-diameter portion 213 is smaller than the diameter of the inner-side middle-diameter portion 212. A first inner-side step portion 214 is formed in the inner casing 21 at a position between the inner-side large-diameter portion 211 and the inner-side middle-diameter portion 212. A second inner-side step portion 215 is formed in the inner casing 21 at a position between the inner-side middle-diameter portion 212 and the inner-side small-diameter portion 213. An inner-side through-hole 23 is formed in the inner-side bottom portion 22, so that the forward end of the injection valve 70 on the injection-port side is exposed to the outside of the cooling device 1 through the inner-side through-hole 23.

The inner jacket 20 is provided at an outer periphery of the injection valve 70 to surround the same. The outer jacket 10 is provided at an outside of the inner jacket 20 to surround the same. More exactly, the inner jacket 20 is in contact with an outer peripheral surface of the injection valve 70. As above, the inner jacket 20 as well as the outer jacket 10 is provided at the outside of the injection valve 70.

The outer-side large-diameter portion 111 of the outer jacket 10 and the inner-side large-diameter portion 211 of the inner jacket 20 are connected to each other at its upper-side end, for example, by welding. In addition, the outer-side bottom portion 12 of the outer jacket 10 and the inner-side bottom portion 22 of the inner jacket 20 are connected to each other, for example, by welding. As a result, an annular space 80 is formed between the outer jacket 10 and the inner jacket 20, so that cooling water flows through the annular space 80.

In a case that the injection valve 70 has a water-proof function, the inner jacket 20 is not always necessary. In such a case, the annular space 80 is formed between the outer jacket 10 and the injection valve 70.

The first pipe portion 41 is formed in the outer-side large-diameter portion 111 of the outer jacket 10 for supplying the cooling water into the annular space 80 or discharging the cooling water from the annular space 80. The second pipe portion 42 is formed in the outer-side middle-diameter portion 112 of the outer jacket 10 for supplying the cooling water into the annular space 80 or discharging the cooling water from the annular space 80. The second pipe portion 42 is located at a position closer to the forward end of the injection valve 70 than the first pipe portion 41 in the axial direction. In the present embodiment, the second pipe portion 42 works as an inlet port for supplying the cooling water into the annular space 80, while the first pipe portion 41 works as an outlet port for discharging the cooling water from the annular space 80.

The cylindrical partitioning unit 30 is provided in the annular space 80 between the outer jacket 10 and the inner jacket 20. The cylindrical partitioning unit 30 divides a part of the annular space 80 into an outside passage 81 on a side of the outer jacket 10 and an inside passage 82 on a side of the injection valve 70. The cylindrical partitioning unit 30 includes a first cylindrical member 31 and a second cylindrical member 32. The first cylindrical member 31 is arranged at an outside of the inner-side middle-diameter portion 212 and the second inner-side step portion 215 of the inner jacket 20. The second cylindrical member 32 is arranged at an outside of the inner-side small-diameter portion 213 of the inner jacket 20.

The first cylindrical member 31 includes a first cylindrical body portion 311, an outwardly extending flange portion 312 which is extending in a radial-outward direction from an upper-side end (the injection-port opposite side) of the first cylindrical member 31, and an inwardly extending flange portion 313 which is extending in a radial-inward direction from a lower-side end (the injection-port side) of the first cylindrical member 31.

A lower-side end of the first cylindrical body portion 311 (equal to the lower-side end of the first cylindrical member 31), which is a part of the first cylindrical body portion 311 adjacent to the inwardly extending flange portion 313, is fixed to an inner peripheral wall of the outer-side middle-diameter portion 112 of the outer jacket 10 by a press-fit process. A press-fit portion between the first cylindrical body portion 311 and the outer jacket 10 works as the first restricting portion 51 for restricting a flow of the cooling water in the annular space 80. The first restricting portion 51 is formed in a circumferential direction of the valve device 1 at a position between the first pipe portion 41 and the second pipe portion 42 in the axial direction of the valve device 1. The first restricting portion 51 restricts the flow of the cooling water between a space of the outside passage 81 on a side of the first pipe portion 41 and a space of the outside passage 81 on a side of the second pipe portion 42. In the present disclosure, the space of the outside passage 81 on the side of the first pipe portion 41 is referred to as a first outside passage portion 811, while the space of the outside passage 81 on the side of the second pipe portion 42 is referred to as a second outside passage portion 812.

In the present embodiment, the first restricting portion 51 completely blocks off the flow of the cooling water between the first outside passage portion 811 and the second outside passage portion 812. However, the first restricting portion 51 may have such a structure, according to which a gap is formed at any circumferential point between the first cylindrical member 31 and the outer-side middle-diameter portion 112 so that a part of the cooling water passes through the gap from the first outside passage portion 811 to the second outside passage portion 812, or vice versa. Therefore, the first restricting portion 51 may have any kinds of structures, according to which pressure loss of the cooling water in the outside passage 81 is increased between the first outside passage portion 811 and the second outside passage portion 812.

An outer peripheral end of the outwardly extending flange portion 312 of the first cylindrical member 31 is in contact with an inner peripheral wall of the outer-side large-diameter portion 111 of the outer jacket 10, at a position that is closer to an upper-side end of the outer jacket 10 on the injection-port opposite side of the first pipe portion 41. A contacting portion between the outwardly extending flange portion 312 and the outer jacket 10 works as the second restricting portion 52 for restricting the flow of the cooling water in the annular space 80. The second restricting portion 52 is formed in the circumferential direction at the position close to the upper-side end of the outer jacket 10. The second restricting portion 52 restricts the flow of the cooling water between the outside passage 81 and the inside passage 82.

A structure of the second restricting portion 52 is not limited to the above structure of the present embodiment, in which the outwardly extending flange portion 312 of the first cylindrical member 31 is in contact with the inner peripheral wall of the outer jacket 10. For example, as explained below in connection with a fifth embodiment, the second restricting portion 52 may be formed in such a manner that an upper-side end of the first cylindrical member 31 is in contact with an inner wall of the first inner-side step portion 214 of the inner jacket 20. Alternatively, the second restricting portion 52 may have such a structure, according to which the upper-side end of the first cylindrical member 31 is in contact with an outer peripheral wall of the inner-side middle-diameter portion 212 of the inner jacket 20.

In the present embodiment, the second restricting portion 52 completely blocks off the flow of the cooling water between the outside passage 81 and the inside passage 82. However, in a similar manner to the first restricting portion 51, the second restricting portion 52 may have such a structure, according to which a gap is formed at any circumferential point so that a part of the cooling water passes through the gap from the outside passage 81 to the inside passage 82, or vice versa. In other words, the second restricting portion 52 may have any kinds of structures, according to which the pressure loss of the cooling water is increased between the outside passage 81 and the inside passage 82, at the position of the upper-side end of the outer jacket 10, that is, at the upper side of the first pipe portion 41.

In the present embodiment, each of an outer peripheral wall of the first cylindrical member 31 and the inner peripheral wall of the outer jacket 10 has a cylindrical shape. More exactly, each of the outer peripheral wall of the first cylindrical body portion 311 of the first cylindrical member 31 and the inner peripheral wall of the outer-side middle-diameter portion 112 of the outer jacket 10, which form the first restricting portion 51, has the cylindrical shape. In addition, each of the outwardly extending flange portion 312 of the first cylindrical member 31 and the inner peripheral wall of the outer-side large-diameter portion 111 of the outer jacket 10, which form the second restricting portion 52, has the cylindrical shape. As a result, it is possible to assemble the first cylindrical member 31 to the outer jacket 10 by optionally selecting an angular position of the first cylindrical member 31 to the outer jacket 10. In other words, the first cylindrical member 31 is such a part, which can be assembled to the outer jacket 10 by rotating the first cylindrical member 31 relative to the outer jacket 10.

In the present embodiment, the first cylindrical member 31 is not in contact with the inner jacket 20. Therefore, the first cylindrical member 31 is also a part, which can be assembled to the outer jacket 10 by rotating the first cylindrical member 31 relative to the outer jacket 10 and the inner jacket 20. Furthermore, the first cylindrical member 31 is also a part, which can be assembled to the outer jacket 10 by rotating the first cylindrical member 31 relative to the second cylindrical member 32.

The second cylindrical member 32 has a second cylindrical body portion 321 and an outwardly extending flange portion 322, which is extending in the radial-outward direction from an upper-side end of the second cylindrical body portion 321. A compressed coil spring 33 is arranged between the outwardly extending flange portion 322 of the second cylindrical member 32 and the second outer-side step portion 115 of the outer jacket 10. The compressed coil spring 33 biases the outwardly extending flange portion 322 of the second cylindrical member 32 in an axial-upward direction, that is, in a direction to the inwardly extending flange portion 313 of the first cylindrical member 31. According to the above structure, the second cylindrical member 32 is fixed to the first cylindrical member 31 and the outer jacket 10. In a condition that the second cylindrical member 32 is fixed to the outer jacket 10 in the annular space 80, a first gap R is formed between a lower-side end of the second cylindrical member 32 and an inner wall of the outer-side bottom portion 12 of the outer jacket 10, so that the cooling water passes through the first gap R (between the outside passage 81 and the inside passage 82).

In the present disclosure, a part of the inside passage 82, which is a space formed inside of the first cylindrical member 31, is referred to as a first inside passage portion 821. Another part of the inside passage 82, which is a space formed inside of the second cylindrical member 32, is referred to as a second inside passage portion 822.

Figure 2:
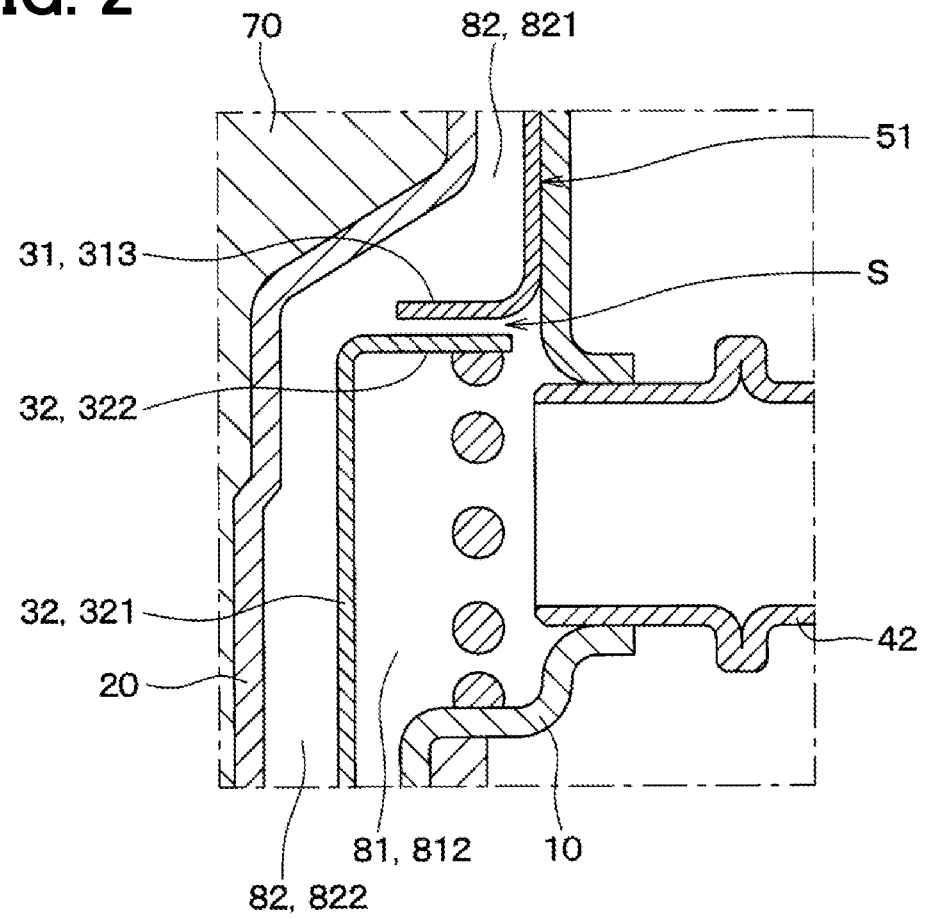
FIG. 2 is a schematically enlarged cross-sectional view showing a portion II in FIG. 1.

As shown in FIGS. 1 and 2, the inwardly extending flange portion 313 of the first cylindrical member 31 is not entirely in contact with the outwardly extending flange portion 322 of the second cylindrical member 32 in the circumferential direction. In other words, the outwardly extending flange portion 322 is separated in the axial direction from the inwardly extending flange portion 313 at a circumferential portion to form a second gap S. According to the above structure, air bubbles contained in the cooling water supplied from the second pipe portion 42 into the second outside passage portion 812 can flow to the first inside passage portion 821 through the second gap S between the inwardly extending flange portion 313 and the outwardly extending flange portion 322. According to the above structure, it is possible to avoid a situation that the cooling water containing the air bubbles flows from the second outside passage portion 812 to the second inside passage portion 822.

Figure 3:
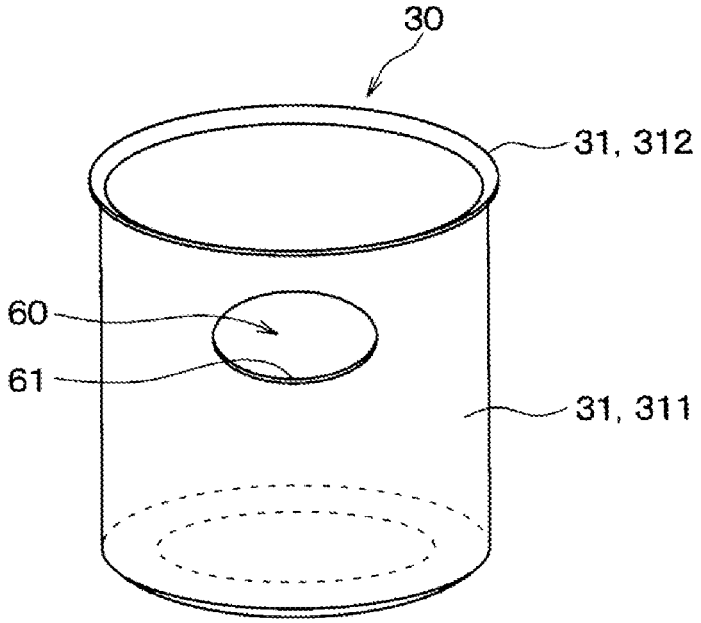
FIG. 3 is a schematic perspective view showing a first cylindrical member, which is one of parts of the cooling device of the first embodiment.

As shown in FIGS. 1 and 3, a through-hole 61 is formed in the first cylindrical member 31 to form the communication passage 60 for communicating the first outside passage portion 811 and the first inside passage portion 821 with each other. As explained above, the first cylindrical member 31 is one of the parts for forming the outside passage 81 and the inside passage 82. The through-hole 61 is formed in the first cylindrical member 31 at a position between the first restricting portion 51 and the second restricting portion 52. Therefore, it is so said that the communication passage 60 is formed in one of the parts for forming the outside passage 81 and the inside passage 82 at the position on the injection-port opposite side of the first restricting portion 51. As explained above, the first cylindrical member 31 is the part which can be assembled to the outer jacket 10, to which the first pipe portion 41 and the second pipe portion 42 are connected, by rotating the first cylindrical member 31 relative to the outer jacket 10. Therefore, it is possible to change a relative position of the communication passage 60 to the outer jacket 10, when the first cylindrical member 31 is assembled to the outer jacket 10 to which the first pipe portion 41 and the second pipe portion 42 are connected.

As shown in FIG. 1, the communication passage 60 is located at a position on an upper side of a solenoid 72 in the axial direction, which forms an electromagnetic driving portion of the injection valve 70. More exactly, the communication passage 60 is preferably provided at a position of the upper side of a lower-side end 721 of the solenoid 72. However, it is more preferable that the communication passage 60 is provided at a position of the upper side of an upper-side end 722 of the solenoid 72.

In addition, the communication passage 60 is located at such a position of the upper side of the solenoid 72 in a vertical direction (a gravity direction), when the cooling device 1 is installed in the vehicle. In other words, the communication passage 60 is preferably located at the position of the upper side of the lower-side end 721 of the solenoid 72 in the vertical direction, when the cooling device 1 is installed in the vehicle. It is more preferable that the communication passage 60 is located at the position of the upper side of the upper-side end 722 of the solenoid 72 in the vertical direction, when the cooling device 1 is installed in the vehicle.

A positional range for providing the communication passage 60 in the cooling device 1 will be explained below.

As shown in FIG. 3, the through-hole 61 for forming the communication passage 60 has an ellipsoidal shape. The ellipsoidal shape has a length in a circumferential direction of the cylindrical partitioning unit 30, which is larger than a length in a axial direction thereof. According to the above structure, it is possible to make an opening area of the communication passage 60 larger, while a lower-side end of the communication passage 60 can be located at a higher position in the vertical direction.

As shown in FIG. 1, the injection valve 70 is provided in the inner jacket 20 of the cooling device 1. The injection valve 70 has a fluid inlet port 75 through which fluid, such as, urea aqueous solution, fuel or the like, flows into a fluid passage 76 of the injection valve 70. The fluid is then injected from the injection port 71. In the present embodiment, the injection valve 70 is composed of an electromagnetically operated valve. Although not shown in the drawings, a needle valve, a movable core for moving the needle valve, a fixed core and so on are provided in the injection valve 70 to open or close the injection port 71. The solenoid 72 is provided at a radial-outside position of the movable core and the fixed core. The movable core, the fixed core, the solenoid 72 and other components form the electromagnetic driving portion of the injection valve 70. The solenoid 72 includes a winding for generating electromagnetic field, when electric power is supplied thereto. The solenoid 72 generates heat when receiving the electric power. It is, therefore, desirable to cool down the solenoid 72 by the cooling device 1. The solenoid 72 is located at a position of an upper side of the second pipe portion 42 of the cooling device 1.

As shown in FIG. 1, the injection valve 70 is directly in contact with the inner jacket 20 in the present embodiment. However, a spacer (not shown) may be provided between the injection valve 70 and the inner jacket 20.

In addition, as shown in FIG. 1, a center axis Ax of the cooling device 1 coincides with a center axis of the injection valve 70 in the present embodiment. However, it is not always necessary to coaxially arrange the injection valve 70 in the cooling device 1.

Figure 4:
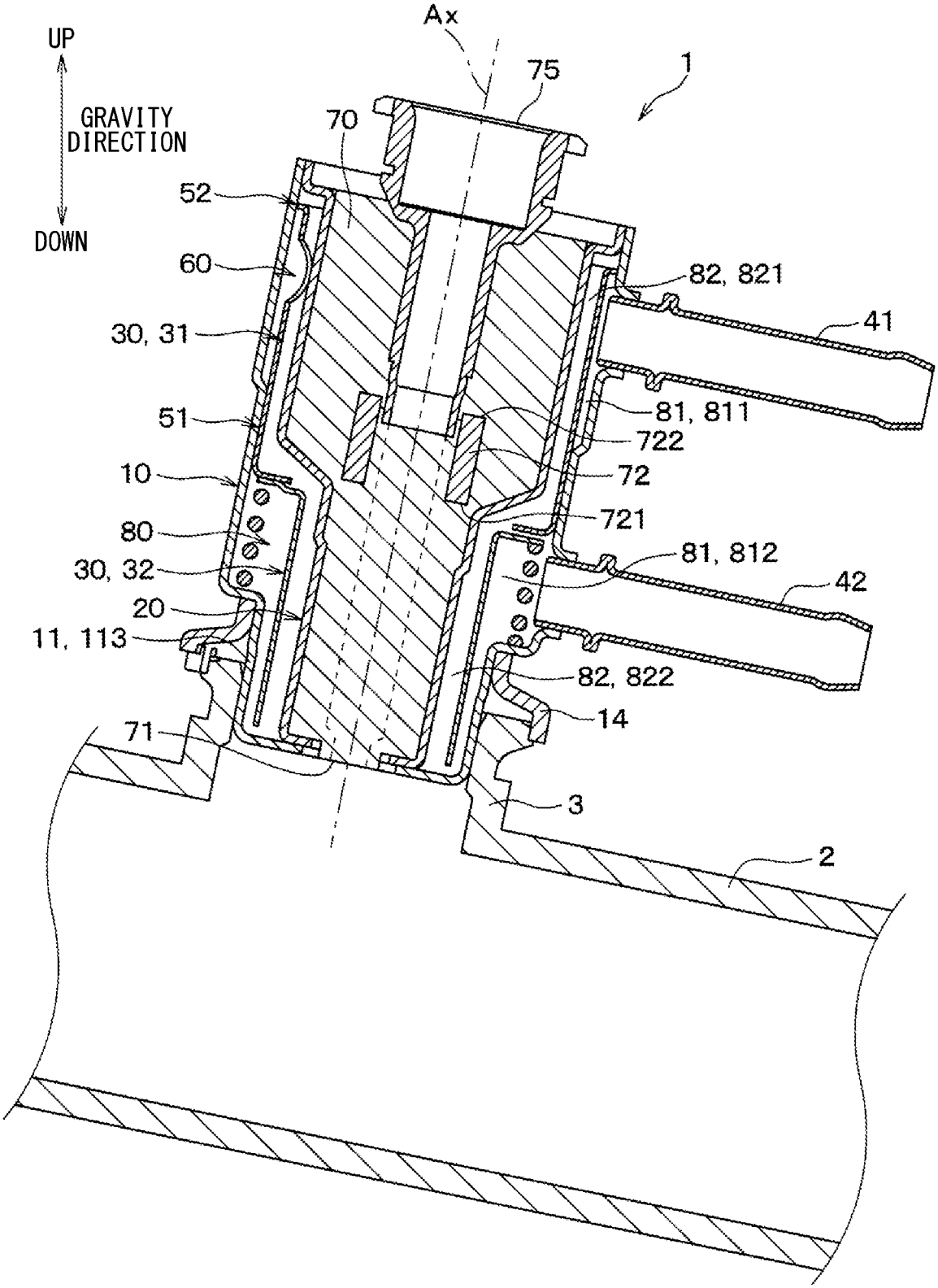
FIG. 4 is a schematic cross-sectional view of the cooling device and shows a condition, in which the cooling device is fixed to an exhaust pipe of an internal combustion engine.

A condition, in which the cooling device 1 is installed in the vehicle (hereinafter, the vehicle-installed condition of the cooling device 1), will be explained. As shown in FIG. 4, the cooling device 1 is fixed to an exhaust pipe 2 of the vehicle (not shown). A fixing portion 3 is formed in the exhaust pipe 2 of the vehicle. A forward end portion of the outer-side small-diameter portion 113 of the outer jacket 10 is inserted into the fixing portion 3. An attachment 14 is provided at an outside of the outer-side small-diameter portion 113 of the outer jacket 10. The cooling device 1 is firmly fixed to the fixing portion 3 of the exhaust pipe 2 by the attachment 14.

As shown in FIG. 4, the cooling device 1 is usually installed in the vehicle in an inclined condition, in which the center axis Ax of the cooling device 1 is inclined with respect to the vertical direction (the gravity direction). In addition, the center axis Ax of the cooling device 1 is further inclined with respect to the vertical direction depending on an inclined condition of the vehicle on a road. The air may enter the cooling water supplied into the annular space 80 of the cooling device 1. In the cooling device 1 of the present embodiment, it is possible to maintain a water-surface level of the cooling water in the annular space 80 at a higher position in the vertical direction. An operation of the cooling device 1 for maintaining the water-surface level at the higher position will be explained with reference to FIG. 5.

Figure 5:
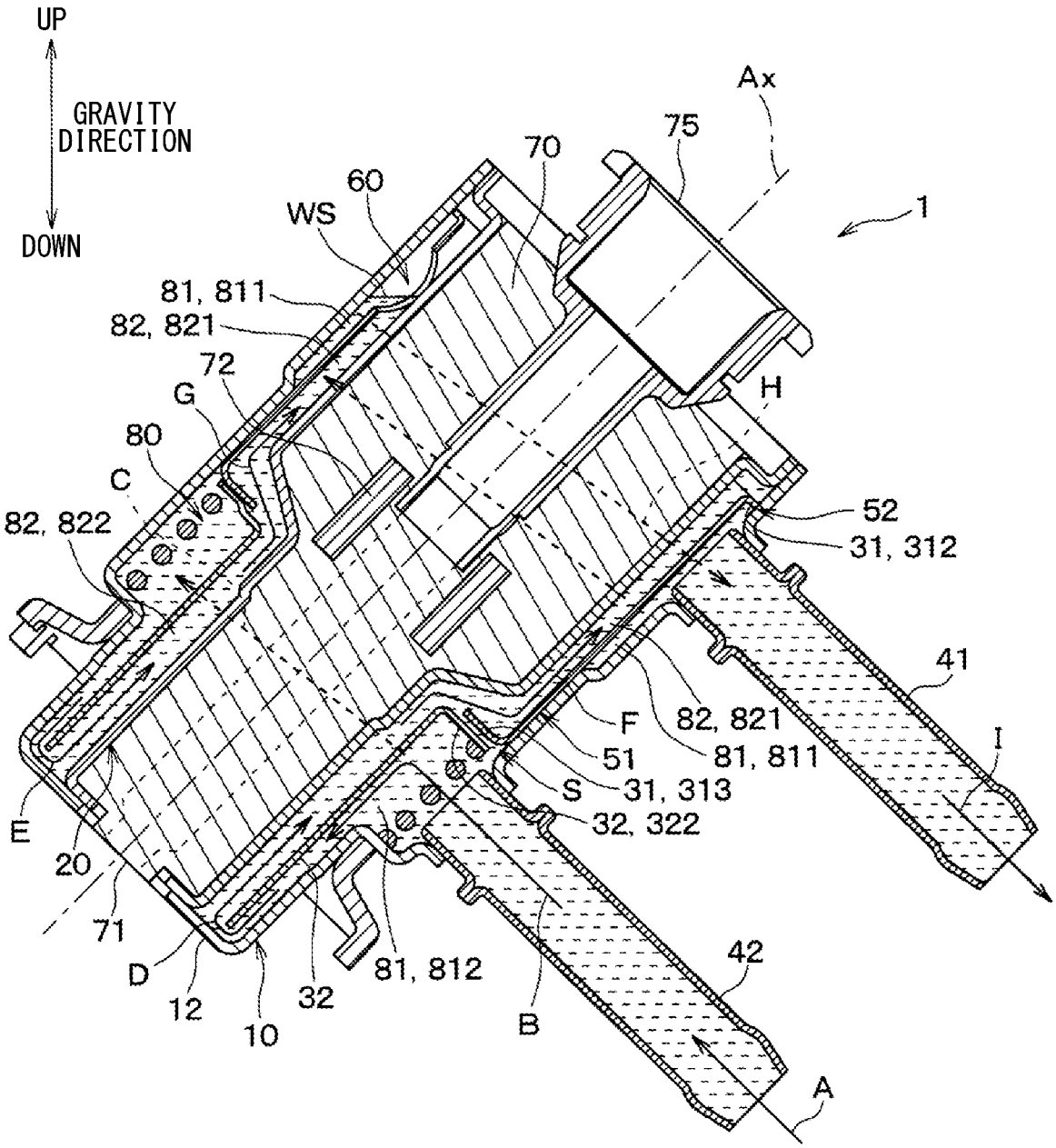
FIG. 5 is a schematic cross-sectional view of the cooling device for explaining a flow of cooling water and a position of a water surface in the cooling device.

FIG. 5 shows a condition that the center axis Ax of the cooling device 1 is inclined with respect to the vertical direction. In FIG. 5, the cooling water flowing in the cooling device 1 is indicated by hatchings of dotted lines, a water surface of the cooling water is indicated by WS, and directions of the flow of the cooling water are indicated by arrows A to I. In the vehicle-installed condition of the cooling device 1, each of the first pipe portion 41 and the second pipe portion 42 is located at a vertically lower position of the outer jacket 10. The vertically lower position corresponds to one of circumferential points of the outer jacket 10, which is lower in the vertical direction than a radially opposite circumferential point of the outer jacket 10 on a plane perpendicular to the center axis Ax.

As indicated by the arrow A in FIG. 5, the cooling water is supplied from a water tank (not shown) to the second pipe portion 42 of the cooling device 1 by a water pump (not shown). As indicated by the arrows B and C, the cooling water flows from the second pipe portion 42 into the second outside passage portion 812 and then to a lower-side end of the cooling device 1 (to the injection-port side). In this fluid flow, the cooling water flowing into the second outside passage portion 812 is prevented by the first restricting portion 51 from flowing into the first outside passage portion 811. The air bubbles, which are contained in the cooling water flowing from the second pipe portion 42 into the second outside passage portion 812, flow in an upward direction due to buoyancy force and flow into the first inside passage portion 821 through the second gap S formed between the inwardly extending flange portion 313 of the first cylindrical member 31 and the outwardly extending flange portion 322 of the second cylindrical member 32.

As indicated by the arrows D and E in FIG. 5, the cooling water flows from the second outside passage portion 812 to the second inside passage portion 822 through the first gap R formed between the lower-side end of the second cylindrical member 32 and the inner wall of the outer-side bottom portion 12 of the outer jacket 10. As indicated by the arrows F and G, the cooling water further flows from the second inside passage portion 822 to the first inside passage portion 821. The cooling water flowing into the first inside passage portion 821 is prevented by the second restricting portion 52 from flowing out into the first outside passage portion 811 by stepping across the outwardly extending flange portion 312 of the first cylindrical member 31. As a result, the cooling water flows from the first inside passage portion 821 into the first outside passage portion 811 through the communication passage 60. As indicated by the arrows H and I, the cooling water flows from the first outside passage portion 811 to the water tank (not shown) through the first pipe portion 41.

As explained above, in the present embodiment, the second restricting portion 52 prevents the cooling water from flowing from the first inside passage portion 821 to the first outside passage portion 811 by stepping across the outwardly extending flange portion 312. It is thereby so structured that the cooling water flows from the first inside passage portion 821 to the first outside passage portion 811 through the communication passage 60. The first cylindrical member 31 having the communication passage 60 can be assembled to the outer jacket 10 having the first pipe portion 41 and the second pipe portion 42 in such a way that an angular position of the first cylindrical member 31 to the outer jacket 10 can be optionally changed. Therefore, the first cylindrical member 31 can be assembled to the outer jacket 10 in such a way that the communication passage 60 is located at an upper position of the first cylindrical member 31 in the vertical direction. The upper position of the first cylindrical member 31 corresponds to one of circumferential positions of the first cylindrical member 31, which is higher in the vertical direction than a radially opposite circumferential position on the plane perpendicular to the center axis Ax. It is thereby possible to maintain the water surface of the cooling water in the annular space 80 at the higher position in the vertical direction.

Figure 6:
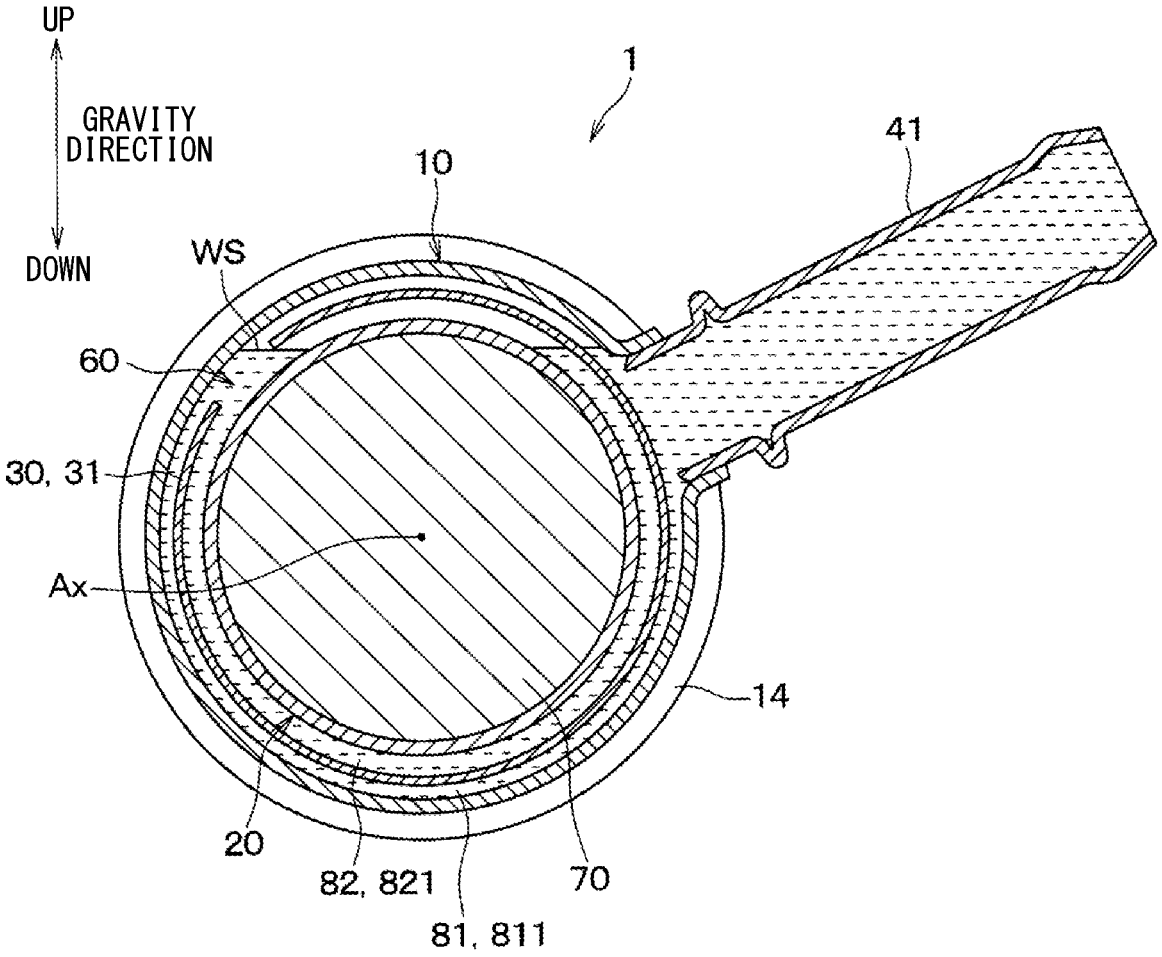
FIG. 6 is another schematic cross-sectional view of the cooling device for explaining the position of the water surface of the cooling water flowing in the cooling device.

FIG. 6 shows a schematic view of the cooling device 1 when viewed it in the axial direction, in the condition that the cooling device 1 is installed in the vehicle. In the condition of FIG. 6, a position of the water surface (the water-surface level) of the cooling water in the annular space 80 is equal to a position of the communication passage 60 (more exactly, at an upper-side end of the through-hole 61 in the vertical direction). As above, when the communication passage 60 is located at the upper position depending on the vehicle-installed condition of the cooling device 1, it is possible to maintain the position of the water surface in the annular space 80 at the higher position in the vertical direction.

The positional range of the communication passage 60 in the cooling device 1 will be explained.

Figure 7:
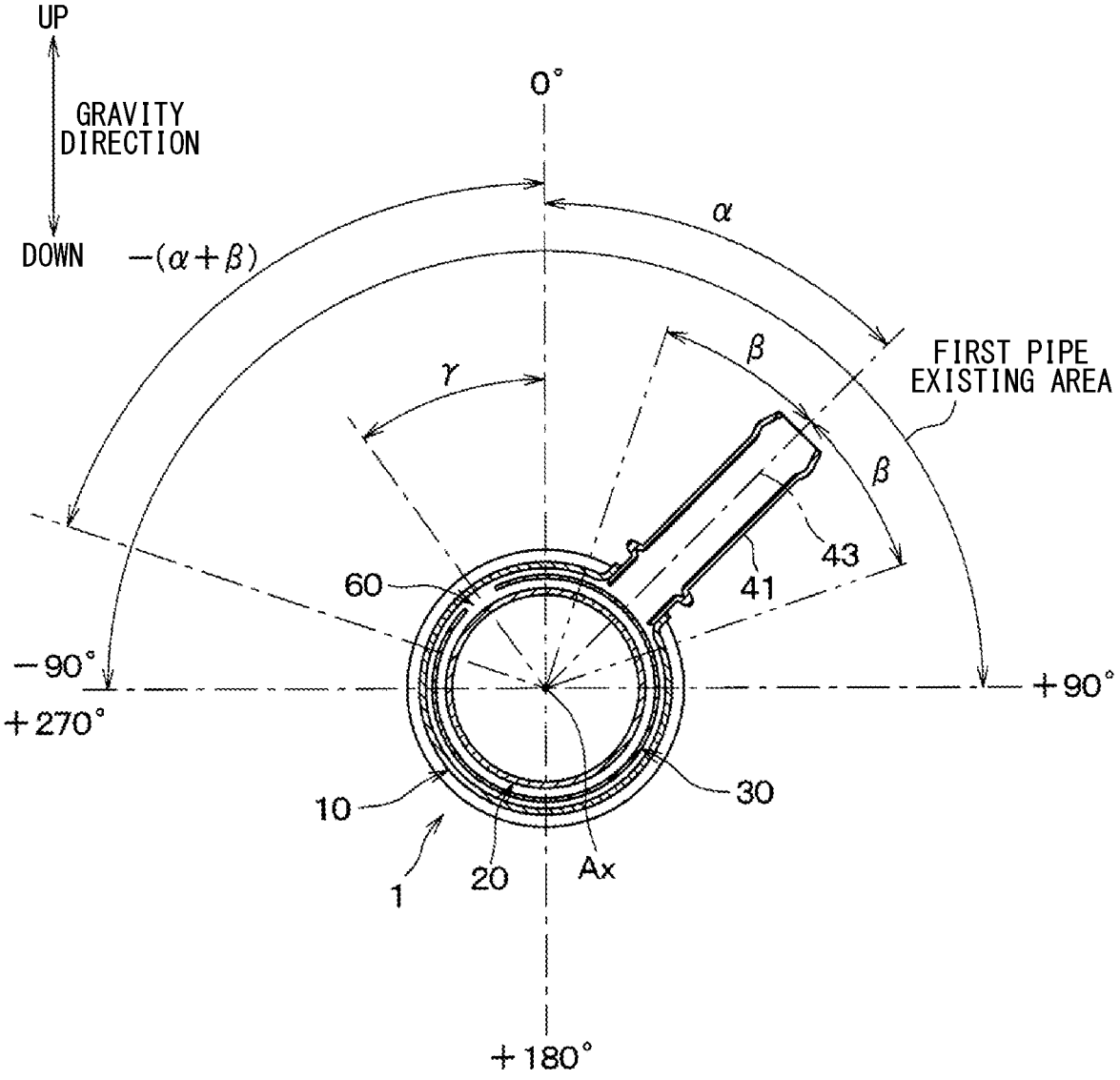
FIG. 7 is a schematic view for explaining a positional range, in which a communication passage is formed.
Figure 8:
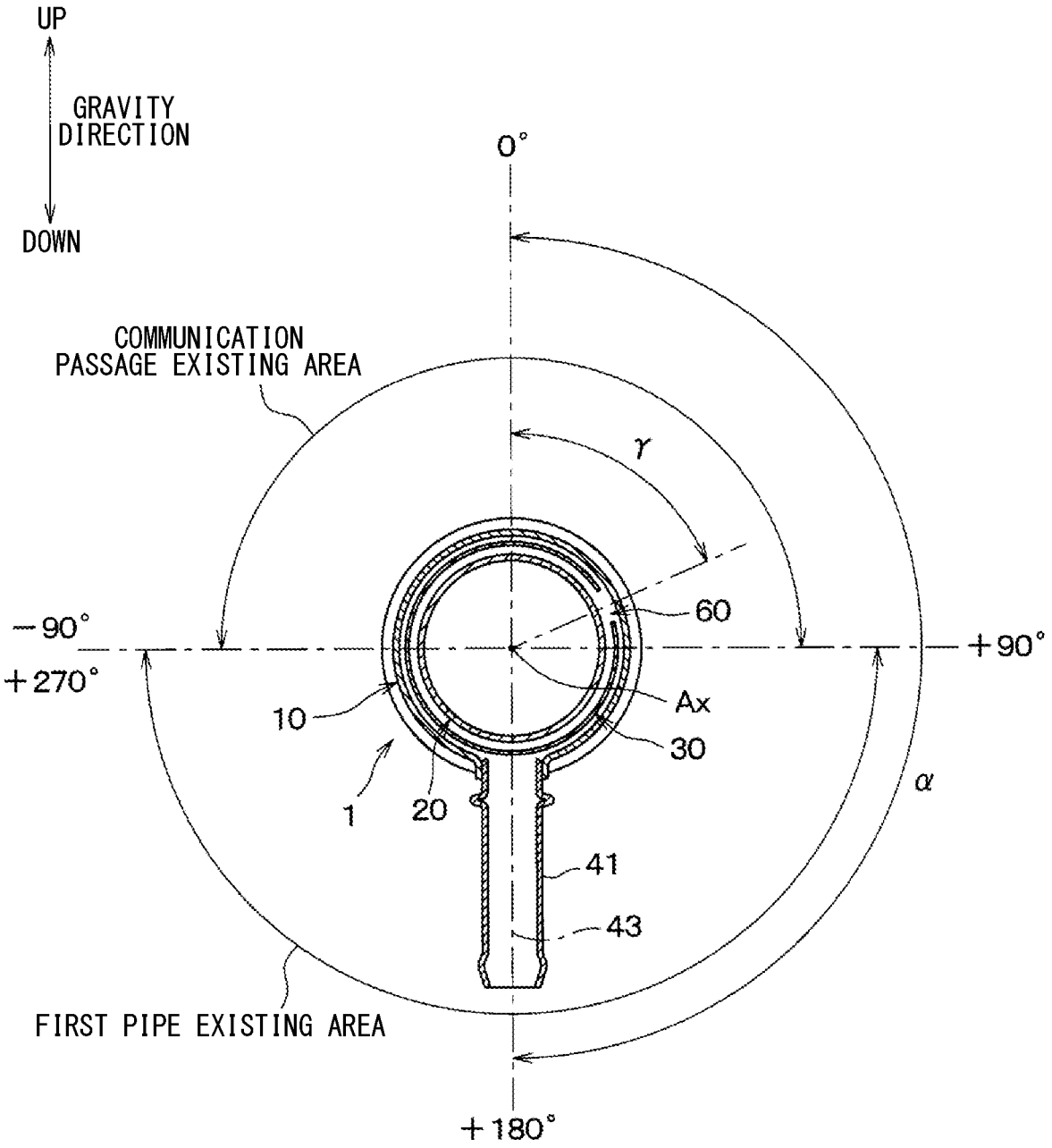
FIG. 8 is another schematic view for explaining the positional range, in which the communication passage is formed.

Each of the FIGS. 7 and 8 is a schematic view showing the cooling device 1 when viewed it in the axial direction. As shown in FIGS. 7 and 8, an angle of a direction of the gravity around the center axis Ax of the cooling device 1 is indicated as 0° (zero degree) in the cross section of the cooling device 1 perpendicular to the center axis Ax thereof. An angle around the center axis Ax of the cooling device 1 between a center axis 43 of the first pipe portion 41 and the gravity direction is indicated by an angle of $\alpha$. When the vehicle is inclined, the cooling device 1 is correspondingly rotated around the center axis Ax. An angle around the center axis Ax of the cooling device 1 between a position before the vehicle inclination and a position after the vehicle inclination is indicated by an angle of $\beta$. A center angle of the communication passage 60 around the center axis Ax of the cooling device 1 between the communication passage 60 (more exactly, a circumferential center thereof) and the gravity direction is indicated by an angle of $\gamma$.

FIG. 7 shows the positional range in which the communication passage 60 is located, when the angle $\alpha$ of the center axis 43 of the first pipe portion 41 around the center axis Ax of the cooling device 1 is within a range of "$-90° < \alpha < +90°$" in the vehicle-installed condition of the cooling device 1.

As shown in FIG. 7, the position of the communication passage 60 is selected to satisfy a relationship of "$-(\alpha+\beta) < \gamma < \alpha$" for the angular range. When the above relationship for the angular range is satisfied, it is possible to maintain the position of the communication passage 60 at the higher position in the vertical direction, even in a condition that the vehicle is held in the horizontal direction or the vehicle is inclined.

The angle $\beta$ around the center axis Ax between the position before the vehicle inclination and the position after the vehicle inclination is set to be, for example, 45°. Alternatively, the angle $\beta$ may be set at a maximum inclination angle of the vehicle, in which the cooling device 1 is installed.

FIG. 8 shows the positional range in which the communication passage 60 is located, when the angle $\alpha$ of the center axis 43 of the first pipe portion 41 around the center axis Ax of the cooling device 1 is within a range of "+90°<α<+270°" in the vehicle-installed condition of the cooling device 1.

As shown in FIG. 8, the position of the communication passage 60 is selected to satisfy a relationship of "−90°<γ<+90°" for the angular range. When the above relationship for the angular range is satisfied, it is possible to maintain the position of the communication passage 60 at the higher position in the vertical direction.

Figure 9:
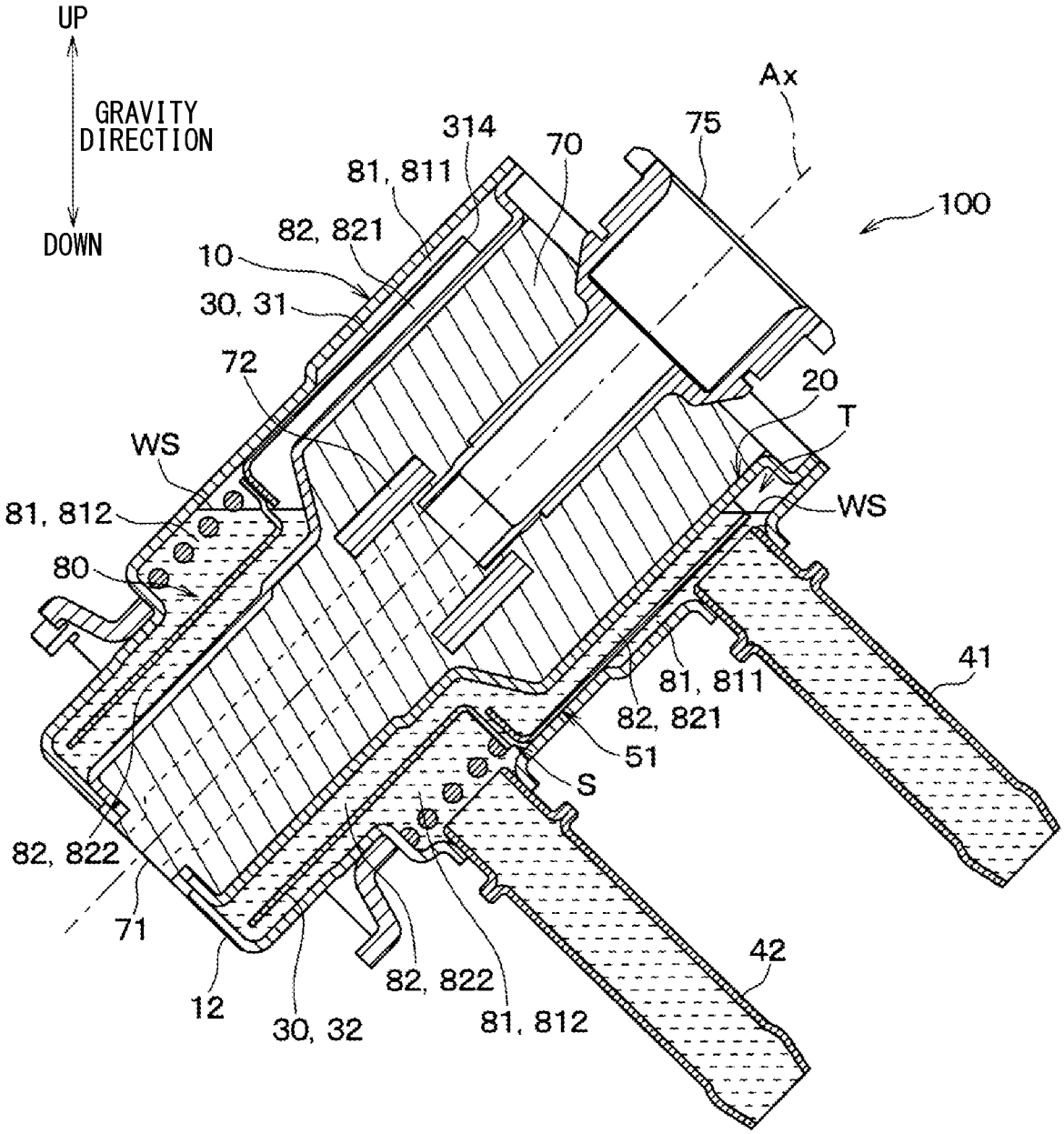
FIG. 9 is a schematic cross-sectional view of a cooling device according to a comparative example for explaining the position of the water surface of the cooling water.

A cooling device 100 of a comparative example will be explained to compare with the cooling device 1 of the first embodiment. FIG. 9 shows the comparative example in the vehicle-installed condition of the cooling device 100. In the condition of FIG. 9, the center axis Ax of the cooling device 100 is inclined with the gravity direction. Each of the first pipe portion 41 and the second pipe portion 42 extends from the outer jacket 10 in a downward direction of the gravity direction.

As shown in FIG. 9, in the cooling device 100 of the comparative example, a portion corresponding to the outwardly extending flange portion 312 of the first embodiment is not provided at an upper-side end 314 of the first cylindrical member 31. In other words, the structure corresponding to the second restricting portion 52 of the first embodiment is not provided in the comparative example. A third gap T is formed in the circumferential direction between the upper-side end 314 and the inner peripheral wall of the outer jacket 10 and between the upper-side end 314 and the outer peripheral wall of the inner jacket 20, so that the cooling water flows through the third gap T from the inside passage 82 to the outside passage 81, or vice versa. According to the above structure, the cooling water can step across the upper-side end 314 of the first cylindrical member 31 and the cooling water can flow from the first inside passage portion 821 to the first outside passage portion 811. In addition, in the comparative example of FIG. 9, a portion corresponding to the through-hole 61 for the communication passage 60 of the first embodiment is not formed in the first cylindrical member 31. As above, the cooling device 100 of the comparative example does not have the structures corresponding to the second restricting portion 52 and the communication passage 60 of the first embodiment.

In the cooling device 100 of the comparative example, the cooling water in the first inside passage portion 821 flows over across the upper-side end 314 of the first cylindrical member 31 to the first outside passage portion 811 and the cooling water is discharged from the cooling device 100 through the first pipe portion 41, when the center axis Ax is inclined with respect to the gravity direction. Therefore, the position of the water surface of the cooling water in the annular space 80 is changed depending on the angular position of the first pipe portion 41 around the center axis Ax.

Figure 10:
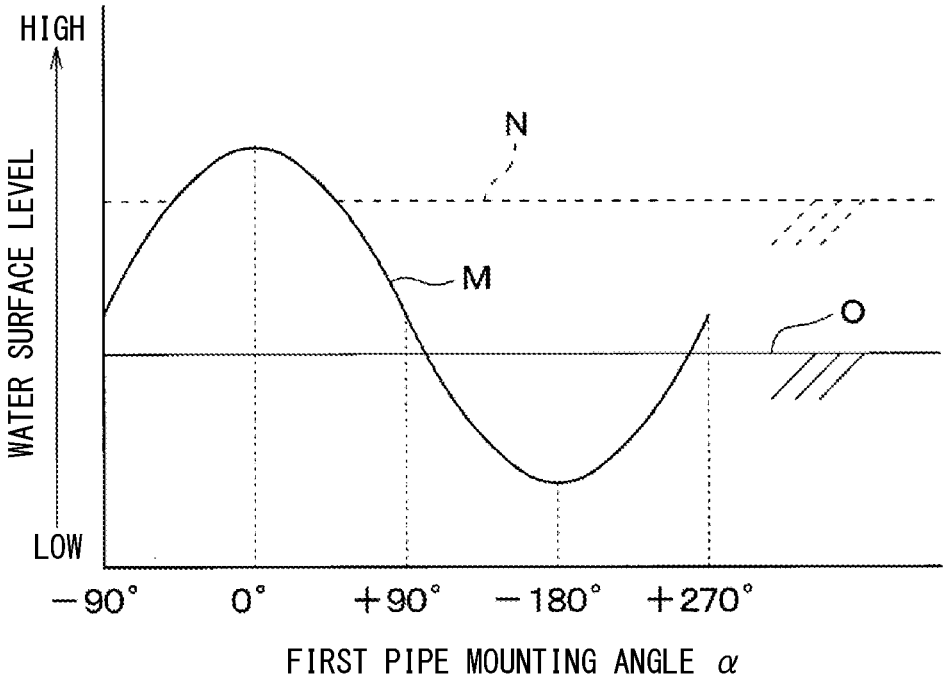
FIG. 10 is a graph showing a positional relationship between a first pipe portion and the position of the water surface of the cooling water.

FIG. 10 shows a relationship between the angular position of the first pipe portion 41 around the center axis Ax of the cooling device and the position/level of the water surface of the cooling water, with respect to the cooling device 1 of the first embodiment and the cooling device 100 of the comparative example. FIG. 10 shows the above relationship, when the center axis Ax of the cooling device is inclined with respect to the gravity direction and when the center axis Ax is moved to the horizontal line.

In FIG. 10, a vertical axis indicates the level (the height) of the water surface of the cooling water in the annular space 80. The level of the water surface is a distance in the gravity direction between a lower-most position of the outer jacket 10 and the position of the water surface.

A horizontal axis of FIG. 10 indicates the angle α of the center axis 43 of the first pipe portion 41 around the center axis Ax of the cooling device 1, when the gravity direction is 0°.

In addition, a solid line M in FIG. 10 shows the level of the water surface of the cooling water flowing through the annular space 80 of the cooling device 100 of the comparative example. A dotted line N in FIG. 10 shows the level of the water surface of the cooling water flowing through the annular space 80 of the cooling device 1 of the first embodiment. A solid line O in FIG. 10 indicates a height of the lower-side end 721 of the solenoid 72 provided in the injection valve 70. The height of the lower-side end 721 of the solenoid 72 is equal to a distance between the outer-side bottom portion 12 of the outer jacket 10 and the lower-side end 721 of the solenoid 72.

As indicated by the solid line M, in the cooling device 100 of the comparative example, the level of the water surface of the cooling water is changed depending on the angular position of the first pipe portion 41 around the center axis Ax of the cooling device 100. In particular, when the angular position (the angle α) of the center axis 43 of the first pipe portion 41 is in a range between "+90°" and "+270°", the level of the water surface of the cooling water becomes lower than the height of the lower-side end 721 of the solenoid 72. Therefore, it becomes difficult to effectively cool down the solenoid 72 in such an angular range. An operating performance of the injection valve 70 may become worse.

On the other hand, as indicated by the dotted line N in FIG. 10, in the cooling device 1 of the first embodiment, the level of the water surface of the cooling water is almost constant, independently of the angular position of the first pipe portion 41 around the center axis Ax of the cooling device 1. The level of the water surface of the cooling water is almost equal to the height of the communication passage 60.

As already explained above, the communication passage 60 is provided at the position higher than the lower-side end 721 of the solenoid 72. As a result, the level of the water surface of the cooling water is higher than that of the lower-side end 721 of the solenoid 72, in the first embodiment. It is therefore possible in the cooling device 1 of the first embodiment to sufficiently cool down the solenoid 72 of the injection valve 70, to thereby avoid the situation that the operational performance of the injection valve 70 becomes worse.

The cooling device 1 of the first embodiment has the following advantages.

(A1) In the present embodiment, the first restricting portion 51 restricts the flow of the cooling water flowing from the second outside passage portion 812 to the first outside passage portion 811. The second restricting portion 52 restricts the flow of the cooling water, which would otherwise step across the outwardly extending flange portion 312 of the first cylindrical member 31 and would flow from the first inside passage portion 821 to the first outside passage portion 811. The communication passage 60 communicates the first inside passage portion 821 and the first outside passage portion 811 to each other. According to the above structure, the cooling water flows from the first inside passage portion 821 to the first outside passage portion 811 through the communication passage 60. When the cooling device 1 is installed in the vehicle in such a way that the communication passage 60 is located at the upper position, it is possible to maintain the level of the water surface of the cooling water at the higher position in the annular space 80 and to increase the cooling performance to the injection valve 70.

(A2) In the present embodiment, the communication passage 60 is formed in the cylindrical partitioning unit 30, which can be rotated relative to the outer jacket 10 when it is assembled.

According to the above structure, the cylindrical partitioning unit 30 can be assembled to the outer jacket 10 depending on a change of the circumferential position of the outer jacket 10 in the vehicle-installed condition of the cooling device. In other words, the cylindrical partitioning unit 30 can be assembled to the outer jacket 10 in such a way that the communication passage 60 is located at the upper position. As a result, it is possible to locate the position of the water surface in the annular space 80 at the higher position. It is, therefore, possible to optionally change the position of the communication passage 60 depending on the vehicle-installed condition of the cooling device, without changing designs for shapes of the respective parts. Accordingly, it is possible to increase flexibility for installing the cooling device in the vehicle.

(A3) In the cooling device 1 of the present embodiment, the inner jacket 20 is provided at the outer periphery of the injection valve 70. The cylindrical partitioning unit 30 can be assembled to the cooling device 1 by rotating the same relative to the inner jacket 20 and the outer jacket 10.

Since the inner jacket 20 is provided in the cooling device 1, it is possible to cool down the injection valve 70, even when it does not have the water-proof function. Even in this case, it is possible to maintain the level of the water surface in the annular space 80 at the higher position, when the cylindrical partitioning unit 30 is assembled to the cooling device depending on the vehicle-installed condition in such a way that the communication passage 60 is located at the upper position.

(A4) In the present embodiment, the communication passage 60 is formed at the upper side of the solenoid 72, which is a part of the electromagnetic driving portion of the injection valve 70.

When the solenoid 72 of the injection valve 70 is located at the upper side of the injection port 71 in the vehicle-installed condition, the communication passage 60 is located at the upper side of the solenoid 72. Therefore, since the water surface in the annular space 80 is located at the upper side of the solenoid 72, it is possible to increase the cooling performance of the cooling device 1 to the injection valve 70.

(A5) In the present embodiment, the communication passage 60 is located at the position above the solenoid 72 of the injection valve 70 in the gravity direction, in the vehicle-installed condition.

Since the water surface in the annular space 80 is located at the position above the solenoid 72 in the vehicle-installed condition, the cooling performance of the cooling device 1 to the injection valve 70 is increased.

(A6) In the present embodiment, when the angle $\alpha$ of the center axis 43 of the first pipe portion 41 around the center axis Ax of the cooling device 1 is within the range of "$-90° < \alpha < +90°$", the communication passage 60 is located at the position which satisfies the relationship of "$-(\alpha+\beta) < \gamma < \alpha$".

In the above relationship, the angle $\gamma$ indicates the center angle of the communication passage 60 around the center axis Ax of the cooling device 1 between the communication passage 60 and the gravity direction. The angle $\beta$ indicates the angle around the center axis Ax of the cooling device 1 between the position before the vehicle inclination and the position after the vehicle inclination, when the vehicle is inclined. For example, the angle $\beta$ can be set at 45°. Alternatively, the angle $\beta$ can be at such a value, which corresponds to the maximum inclination angle when the vehicle having the cooling device 1 is inclined.

According to the above structure, it is possible to locate the communication passage 60 at the upper position in the gravity direction, not only when the vehicle is horizontal on the road but also when the vehicle is inclined with respect to the gravity direction.

(A7) In the present embodiment, when the angle $\alpha$ of the center axis 43 of the first pipe portion 41 around the center axis Ax of the cooling device 1 is within the range of "$+90° < \alpha < +270°$", the communication passage 60 is located at the position which satisfies the relationship of "$-90° < \gamma < +90°$".

According to the above structure, it is also possible to locate the communication passage 60 at the upper position in the gravity direction.

(A8) In the present embodiment, the communication passage 60 has the ellipsoidal shape, the length of which in the circumferential direction of the cylindrical partitioning unit 30 is larger than the length of the ellipsoidal shape in the axial direction of the cylindrical partitioning unit 30.

According to the above structure, it is possible to locate the lower-side end of the communication passage 60 at the higher position, while the opening area of the communication passage 60 can be increased. Accordingly, it is possible to decrease the pressure loss of the cooling water passing through the communication passage 60 and thereby to increase the flow amount of the cooling water. In addition, the level of the water surface can be increased. It is, therefore, possible to increase the cooling performance of the cooling device 1 to the injection valve 70.

Further Embodiments

In the following second to sixth embodiments, the structure of the communication passage is different from that of the communication passage 60 of the first embodiment. The other portions are the same to those of the first embodiment. Such portions which are different from those of the first embodiment will be explained.

Second Embodiment

Figure 11:
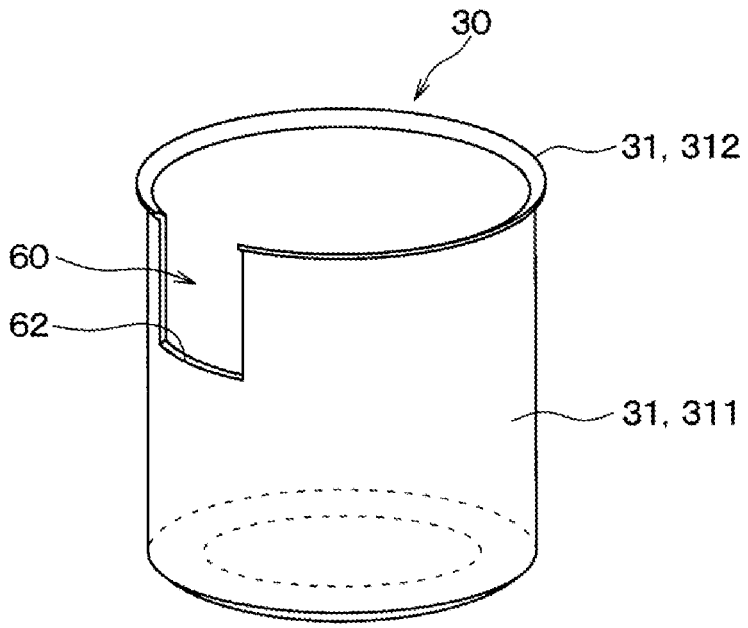
FIG. 11 is a schematic perspective view showing the first cylindrical member, which is one of the parts of the cooling device according to a second embodiment.

As shown in FIG. 11, the communication passage 60 of a second embodiment is composed of a notched portion 62, which is formed on an upper side of the first cylindrical member 31 and at a part of the first cylindrical member 31 in the circumferential direction. In the notched portion 62, a portion of the outwardly extending flange portion 312 of the first cylindrical member 31 is cut out, wherein the notched portion 62 extends in the axial-downward direction to an axial middle point of the first cylindrical body portion 311. The notched portion 62 works as the communication passage 60 for communicating the first inside passage portion 821 and the first outside passage portion 811 to each other.

Third Embodiment

Figure 12:
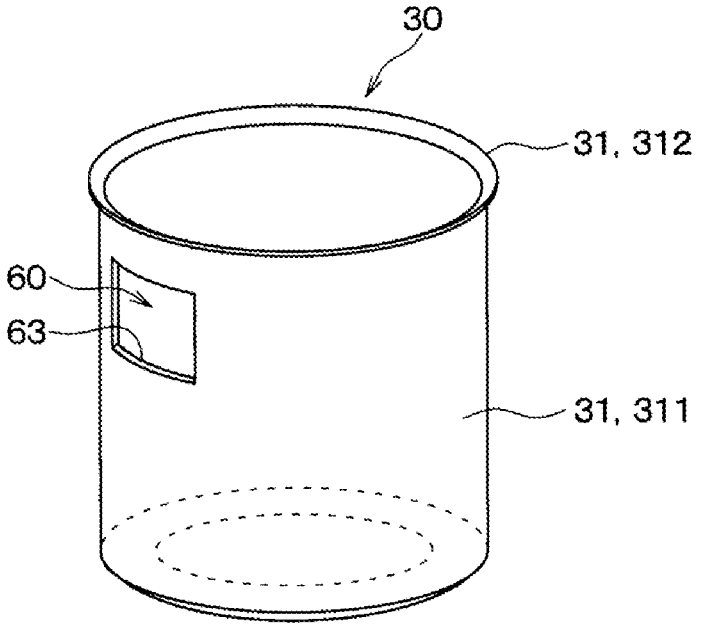
FIG. 12 is a schematic perspective view showing the first cylindrical member, which is one of the parts of the cooling device according to a third embodiment.

As shown in FIG. 12, the communication passage 60 of a third embodiment is composed of a through-hole 63 of a square shape, which is formed on the upper side of the first cylindrical member 31 and at the part of the first cylindrical member 31 in the circumferential direction. The through-hole 63 works as the communication passage 60 for communicating the first inside passage portion 821 and the first outside passage portion 811 to each other.

Fourth Embodiment

Figure 13:
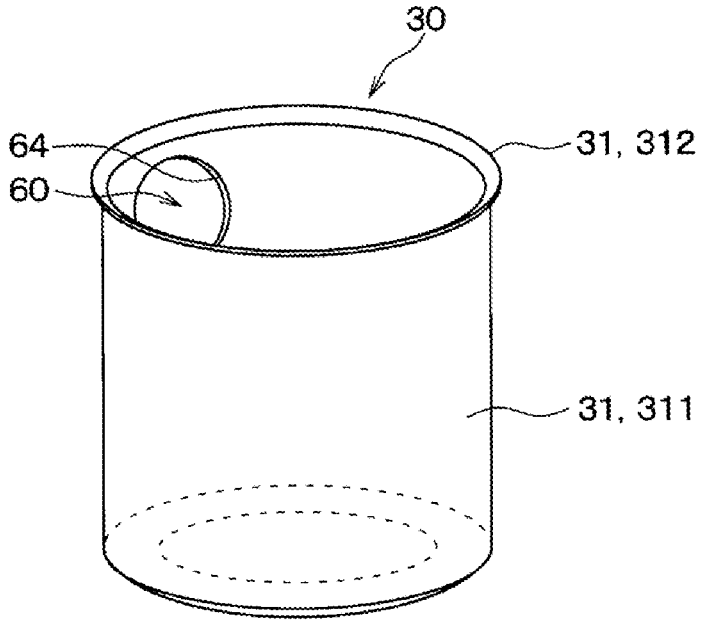
FIG. 13 is a schematic perspective view showing the first cylindrical member, which is one of the parts of the cooling device according to a fourth embodiment.

As shown in FIG. 13, the communication passage 60 of a fourth embodiment is composed of a through-hole 64 of a circular shape, which is likewise formed on the upper side of the first cylindrical member 31 and at the part of the first cylindrical member 31 in the circumferential direction. The through-hole 64 works as the communication passage 60 for communicating the first inside passage portion 821 and the first outside passage portion 811 to each other.

Fifth Embodiment

Figure 14:
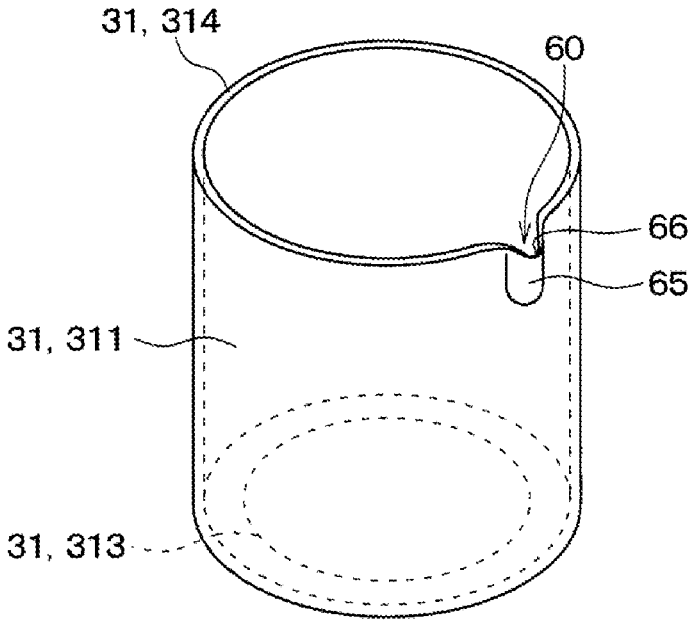
FIG. 14 is a schematic perspective view showing the first cylindrical member, which is one of the parts of the cooling device according to a fifth embodiment.
Figure 15:
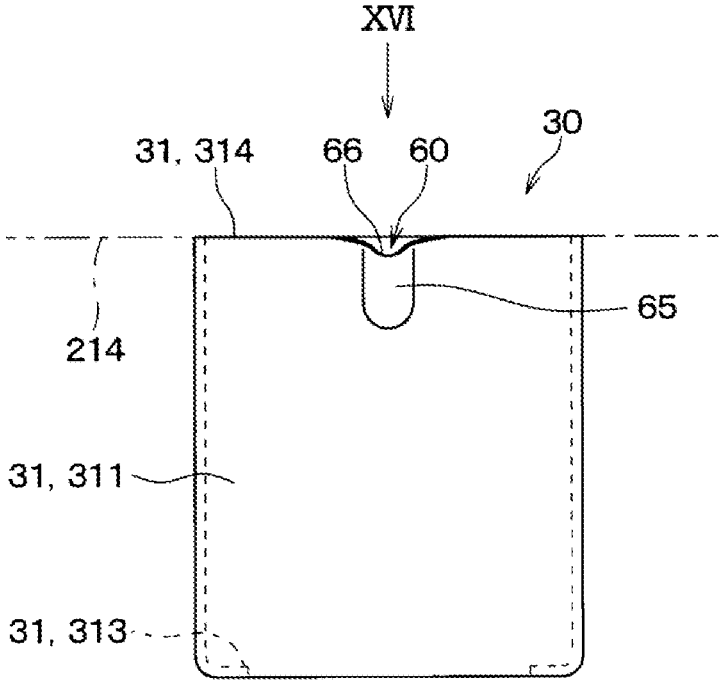
FIG. 15 is a schematic front view showing the first cylindrical member of the fifth embodiment.
Figure 16:
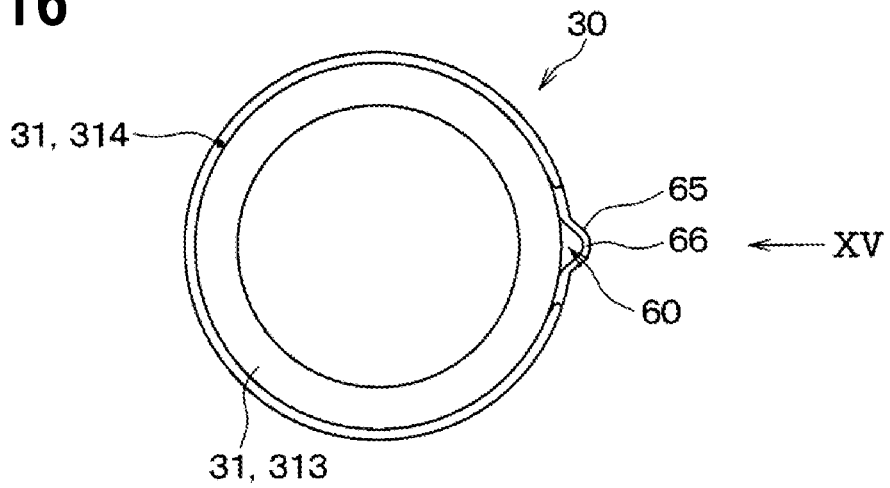
FIG. 16 is a schematic top-plan view showing the first cylindrical member of the fifth embodiment.
Figure 17:
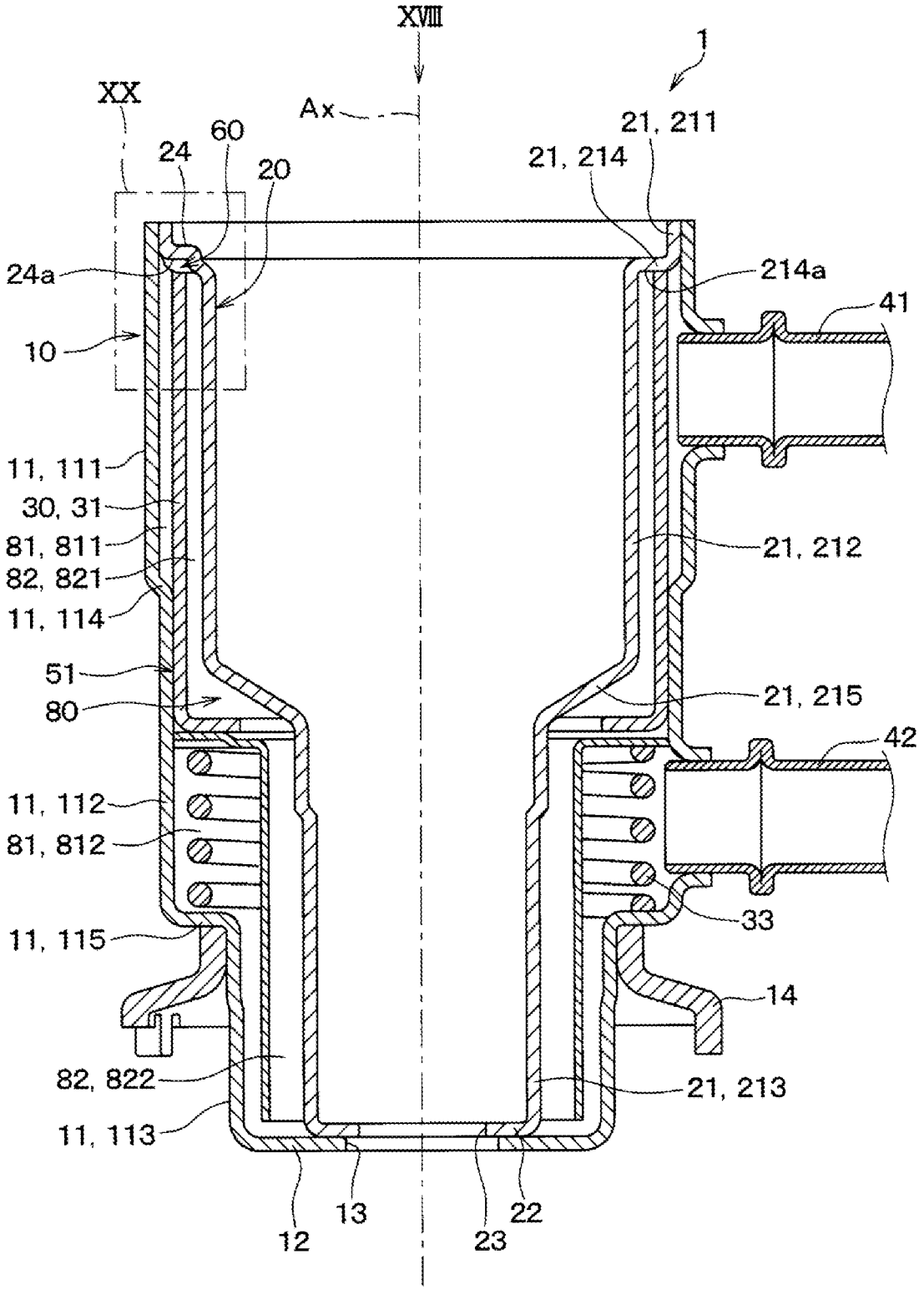
FIG. 17 is a schematic cross-sectional view showing a cooling device for an injection valve according to a sixth embodiment.
Figure 18:
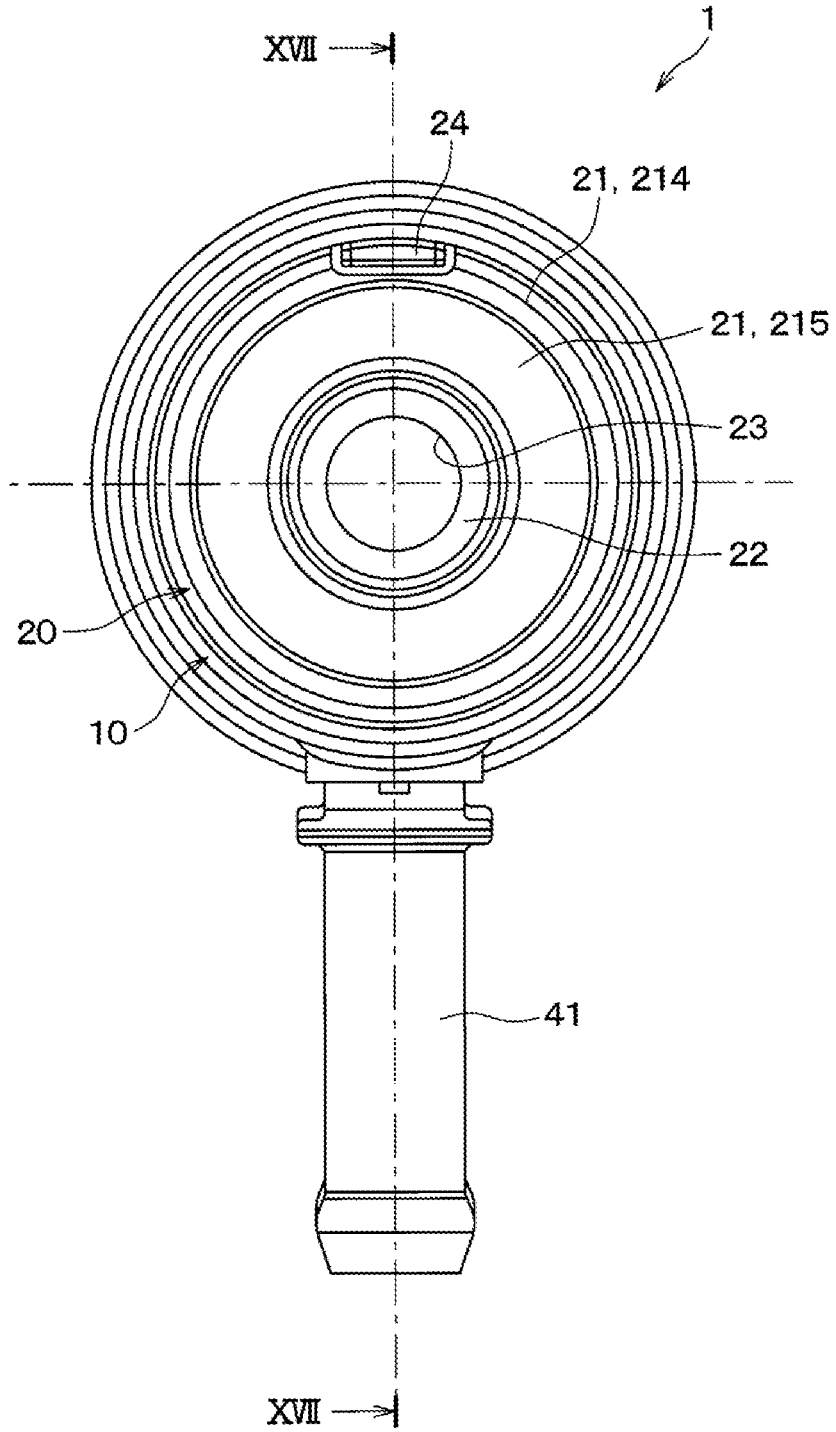
FIG. 18 is a schematic top-plan view of the cooling device, when viewed it in a direction of an arrow XVIII in FIG. 17.
Figure 19:
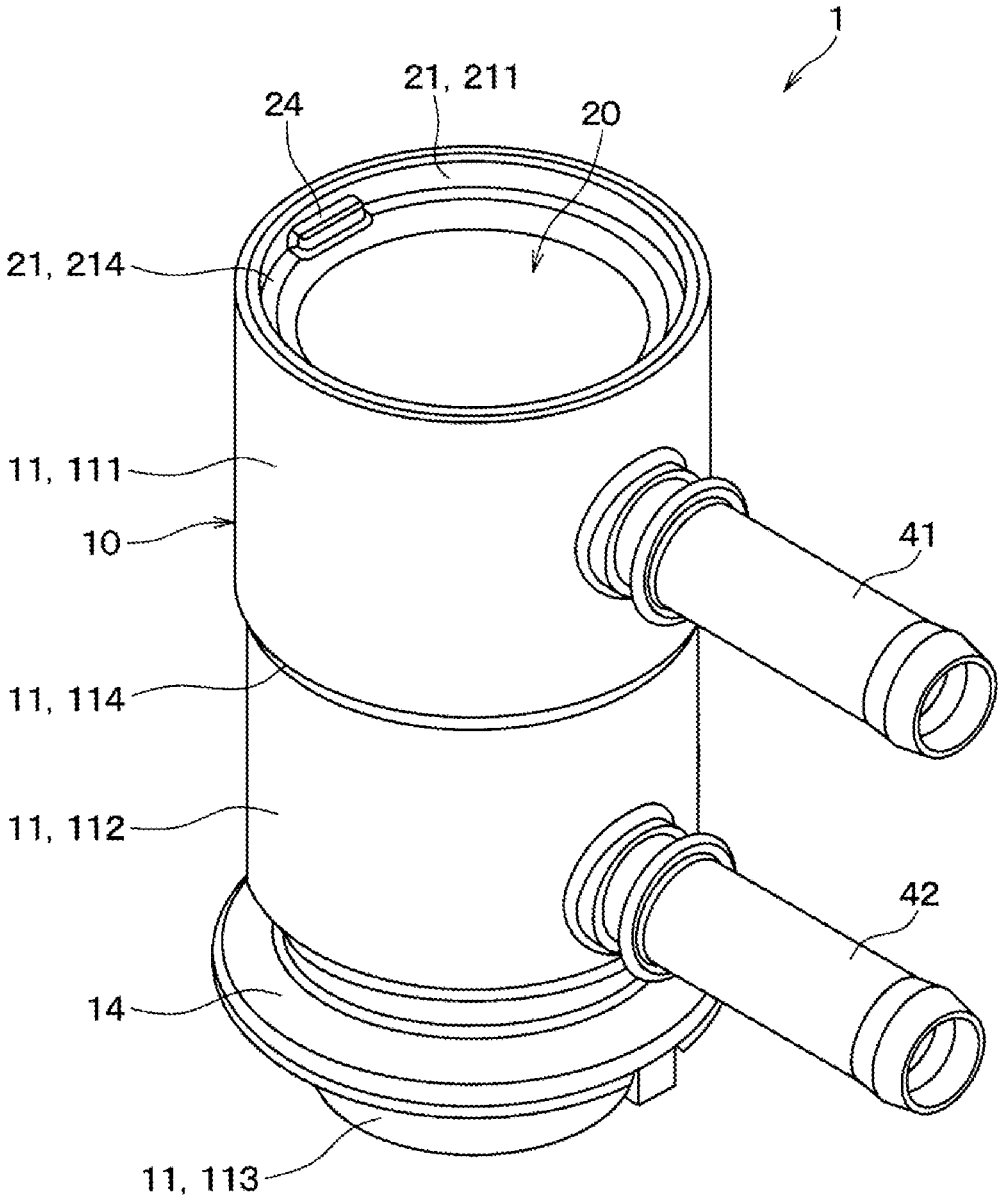
FIG. 19 is a schematic perspective view showing the cooling device of the sixth embodiment.
Figure 20:
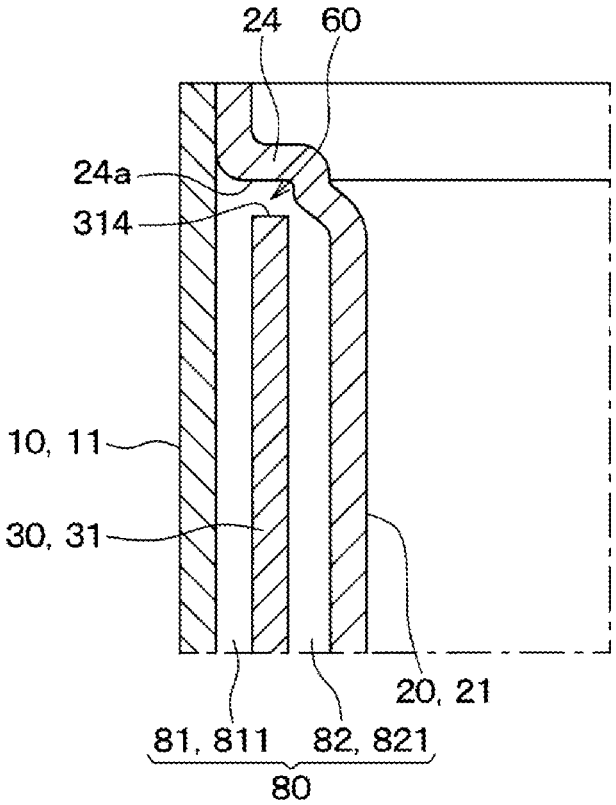
FIG. 20 is a schematically enlarged cross-sectional view showing a portion XX in FIG. 17.

As shown in FIGS. 14 to 16, the communication passage 60 of a fifth embodiment is composed of an outwardly expanded portion 65, wherein a circumferential part of the first cylindrical member 31 of the upper side is expanded in the radial-outward direction. An upper-side end surface 66 of the outwardly expanded portion 65 is located at a position lower than the upper-side end 314 of the first cylindrical member 31 in the vertical direction, that is, at the position on a lower side of a plane formed by the upper-side end 314.

In the fifth embodiment, the structure corresponding to the outwardly extending flange portion 312 of the first embodiment is not formed in the first cylindrical member 31. When the first cylindrical member 31 is assembled into the annular space 80 of the cooling device 1, the upper-side end 314 of the first cylindrical member 31 is brought into contact with the inner wall surface of the first inner-side step portion 214 of the inner jacket 20 in the axial direction. As shown in FIG. 15, when the first cylindrical member 31 is assembled in the annular space 80 of the cooling device 1, the communication passage 60 is formed between the upper-side end surface 66 of the outwardly expanded portion 65 and the inner wall surface of the first inner-side step portion 214 of the inner jacket 20. In FIG. 15, the inner wall surface of the first inner-side step portion 214 of the inner jacket 20 is indicated by a one-dot-chain line. The inner wall surface of the first inner-side step portion 214 is formed by a flat surface and it extends in the circumferential direction.

In each of the above second to fifth embodiments, the cooling water in the annular space 80 also flows from the first inside passage portion 821 to the first outside passage portion 811, or vice versa, through the communication passage 60.

When the communication passage 60 is located at the upper position in the cooling device 1 depending on the vehicle-installed condition of the cooling device 1, it is possible to maintain the position of the water surface in the annular space 80 at the higher position in the vertical direction. The cooling performance of the cooling device 1 to the injection valve 70 can be thus increased.

In addition, in each of the above second to fifth embodiments, the communication passage 60 is formed in the cylindrical partitioning unit 30, which can be assembled to the outer jacket 10 by rotating the cylindrical partitioning unit 30 relative to the outer jacket 10. It is, therefore, possible to optionally change the position of the communication passage 60 depending on the vehicle-installed condition of the cooling device 1, without changing the design for the shapes of the respective parts. Accordingly, it is possible to increase the flexibility for installing the cooling device 1 in the vehicle. The same advantages to those of the first embodiment can be also obtained in each of the second to fifth embodiments.

Sixth Embodiment

In the cooling device 1 of a sixth embodiment, the communication passage 60 is formed in the inner jacket 20, which is different from the structure of the first to fifth embodiments. In FIGS. 17 to 20 showing the cooling device 1 of the sixth embodiment, the injection valve 70 is omitted from the drawings.

As shown in FIGS. 17 to 20, the communication passage 60 is formed by an upwardly expanded portion 24, which is a circumferential part of the first inner-side step portion 214 of the inner jacket 20 and which is expanded in the axial-upward direction of the inner jacket 20. A lower-side surface 24*a* of the upwardly expanded portion 24, that is, a part of the inner wall surface of the inner jacket 20 at the upwardly expanded portion 24 on the side to the annular space 80, is located at a position higher in the axial direction than a lower-side surface 214*a* of the first inner-side step portion 214 of the inner jacket 20. In other words, the lower-side surface 24*a* of the upwardly expanded portion 24 is located at the position more away in the axial-upward direction from the injection port 71 than the lower-side surface 214*a* of the first inner-side step portion 214.

In the sixth embodiment, the structure corresponding to the outwardly extending flange portion 312 of the first embodiment is not formed in the first cylindrical member 31. When the first cylindrical member 31 is assembled in the annular space 80 of the cooling device 1, the upper-side end 314 of the first cylindrical member 31 is brought into contact with the lower-side surface 214*a* of the first inner-side step portion 214 of the inner jacket 20. A portion of the upper-side end 314 of the first cylindrical member 31, which is in contact with the lower-side surface 214*a* of the first inner-side step portion 214, works as the second restricting portion 52 for restricting the flow of the cooling water in the annular space 80. The communication passage 60 is thereby formed between the lower-side surface 24*a* of the upwardly expanded portion 24 of the inner jacket 20 and the upper-side end 314 of the first cylindrical member 31.

In the cooling device 1 of the sixth embodiment, the cooling water in the annular space 80 flows from the first inside passage portion 821 to the first outside passage portion 811, or vice versa, through the communication passage 60. Since the communication passage 60 can be located at the higher position in the vertical direction depending on the vehicle-installed condition of the cooling device 1, it is possible to maintain the water surface in the annular space 80 at the higher position and thereby to increase the cooling performance for the injection valve 70.

In addition, in the sixth embodiment, the communication passage 60 is formed in the inner jacket 20, which can be assembled to the outer jacket 10 by rotating the inner jacket 20 relative to the outer jacket 10. It is, therefore, possible to optionally change the position of the communication passage 60 depending on the vehicle-installed condition of the cooling device 1, without changing the design for the shapes of the respective parts. Accordingly, it is possible to increase the flexibility for installing the cooling device 1 in the vehicle. The same advantages to those of the first embodiment can be also obtained in the sixth embodiment.

Further Embodiments and/or Modifications

The present disclosure is not limited to the above embodiments but can be further modified in various manners without departing from a spirit of the present disclosure, for example, in the following ways.

(M1) In the above embodiments, the cooling device 1 is applied to the injection valve 70 for cooling down the same, wherein the injection valve 70 is used in the SCR system or used for regenerating the DPF. However, the cooling device 1 can be applied to any other types of the injection valves to be installed in the vehicle.

(M2) In the cooling device 1 of the above embodiments, the cooling water is supplied into the annular space 80 from the second pipe portion 42 and discharged from the first pipe portion 41. However, the cooling device can be so modified that the cooling water is supplied into the annular space 80 from the first pipe portion 41 and discharged from the second pipe portion 42.

(M3) In the above embodiments, the cylindrical partitioning unit 30 is composed of the first cylindrical member 31 and the second cylindrical member 32. However, it may be so modified that the cylindrical partitioning unit 30 is composed of only the first cylindrical member 31 and the second cylindrical member 32 is eliminated. Alternatively, the first and the second cylindrical members 31 and 32 may be integrally formed with each other.

(M4) In the above embodiments, each of the first cylindrical member 31 and the outer jacket 10 is formed in the cylindrical shape having a circular cross section. However, each of the first cylindrical member 31 and the outer jacket 10 is so formed that each of cross sectional shapes on a plane perpendicular to the axial direction has a polygonal shape. When the first cylindrical member 31 of such a modified shape is assembled to the outer jacket 10, the first cylindrical member 31 is rotated around its center axis by a predetermined angle, in a stepwise manner, relative to the outer jacket 10.

(M5) In the above embodiments, the first restricting portion 51 is formed by press-inserting the first cylindrical member 31 into the outer jacket 10. However, the first restricting portion 51 may be so formed by providing a separate member between the outer jacket 10 and the first cylindrical member 31.

(M6) In the above embodiments, the second restricting portion 52 is formed by bringing the first cylindrical member 31 into contact with the outer jacket 10 or the inner jacket 20. However, the second restricting portion 52 may be so formed by providing a separate member between the outer jacket 10 and the first cylindrical member 31 or between the inner jacket 20 and the first cylindrical member 31.

What is claimed is:

1. A cooling device for cooling down an injection valve installed in a vehicle comprising:

an outer jacket provided at an outside of the injection valve for forming an annular space between the injection valve and the outer jacket, so that cooling water flows through the annular space;

a cylindrical partitioning unit formed in a cylindrical shape and provided between the injection valve and the outer jacket, the cylindrical partitioning unit divides a part of the annular space into an outside passage on a side of the outer jacket and an inside passage on a side of the injection valve;

a first pipe portion connected to the outer jacket for supplying the cooling water into the annular space or discharging the cooling water from the annular space;

a second pipe portion connected to the outer jacket for supplying the cooling water into the annular space or discharging the cooling water from the annular space, wherein the first pipe portion is connected to the outer jacket at a position higher than the second pipe portion in a vertical direction;

a first restricting portion provided in the annular space at a position between the first pipe portion and the second pipe portion for restricting a flow of the cooling water between a first outside passage portion and a second outside passage portion, the first outside passage portion being a part of the outside passage on an upper side and being communicated to the first pipe portion, and the second outside passage portion being another part of the outside passage on a lower side and being communicated to the second pipe portion;

a second restricting portion provided in the annular space at a position higher than the first pipe portion in the vertical direction for restricting the flow of the cooling water between the outside passage and the inside passage; and a communication passage formed in a cylindrical component at its circumferential position, which is higher than the first restricting portion in the vertical direction, wherein:

the communication passage communicates the outside passage and the inside passage with each other;

the cylindrical component is one of members for forming the outside passage and/or the inside passage;

when an angular position of a center axis of the first pipe portion is in a range of "$-90° < \alpha < +90°$", an angular position of a center of the communication passage is within a range of "$-(\alpha+\beta) < \gamma < \alpha$";

"$\alpha$" is an angle between the center axis of the first pipe portion and the vertical direction;

"$\beta$" is an angle of an inclination in the center axis of the first pipe portion around a center axis of the cooling device, when the vehicle is inclined;

"$\gamma$" is an angle between a center of the communication passage and the vertical direction; and each of the angles "$\alpha$", "$\beta$" and "$\gamma$" is measured on a plane perpendicular to the center axis of the cooling device in a condition that the cooling device is installed in the vehicle, and wherein the vertical direction corresponds to the gravity direction which is set at an angle of "0° (zero degree)".

2. The cooling device according to claim 1, wherein the communication passage is formed in the cylindrical component, which is rotatable relative to the first pipe portion and the second pipe portion when the cylindrical component is assembled in the cooling device.

3. The cooling device according to claim 1, wherein the cylindrical partitioning unit is rotatable relative to the outer jacket when the cylindrical partitioning unit is assembled to the outer jacket, and the communication passage is formed in the cylindrical partitioning unit.

4. The cooling device according to claim 1, further comprising;

an inner jacket provided at the outside of the injection valve, wherein the annular space is formed between the inner jacket and the outer jacket, and the cylindrical partitioning unit is rotatable relative to the inner jacket and the outer jacket, when the cylindrical partitioning unit is assembled to the inner jacket and the outer jacket.

5. The cooling device according to claim 1, wherein the communication passage is formed in the cylindrical component at a position, which is higher than a solenoid of the injection valve in the vertical direction.

6. The cooling device according to claim 1, wherein the communication passage is formed in the cylindrical component at a position, which is higher than a solenoid of the injection valve in the vertical direction, in a condition that the cooling device is installed in the vehicle.

7. The cooling device according to claim 1, wherein the communication passage is formed in the cylindrical partitioning unit, and a length of the communication passage in a circumferential direction of the cylindrical partitioning unit is larger than a length of the communication passage in an axial direction of the cylindrical partitioning unit.

8. A cooling device for cooling down an injection valve installed in a vehicle comprising:

an outer jacket provided at an outside of the injection valve for forming an annular space between the injection valve and the outer jacket, so that cooling water flows through the annular space;

a cylindrical partitioning unit formed in a cylindrical shape and provided between the injection valve and the outer jacket, the cylindrical partitioning unit divides a part of the annular space into an outside passage on a side of the outer jacket and an inside passage on a side of the injection valve;

a first pipe portion connected to the outer jacket for supplying the cooling water into the annular space or discharging the cooling water from the annular space;

a second pipe portion connected to the outer jacket for supplying the cooling water into the annular space or discharging the cooling water from the annular space, wherein the first pipe portion is connected to the outer jacket at a position higher than the second pipe portion in a vertical direction;

a first restricting portion provided in the annular space at a position between the first pipe portion and the second pipe portion for restricting a flow of the cooling water between a first outside passage portion and a second outside passage portion, the first outside passage portion being a part of the outside passage on an upper side and being communicated to the first pipe portion, and the second outside passage portion being another part of the outside passage on a lower side and being communicated to the second pipe portion;

a second restricting portion provided in the annular space at a position higher than the first pipe portion in the vertical direction for restricting the flow of the cooling water between the outside passage and the inside passage; and a communication passage formed in a cylindrical component at its circumferential position, which is higher than the first restricting portion in the vertical direction, wherein:

the communication passage communicates the outside passage and the inside passage with each other;

the cylindrical component is one of members for forming the outside passage and/or the inside passage;

when an angular position of a center axis of the first pipe portion is in a range of "$+90° < \alpha < +270°$", an angular position of a center of the communication passage is within a range of "$-90° < \gamma < +90°$";

"$\alpha$" is an angle between the center axis of the first pipe portion and the vertical direction;

"$\beta$" is an angle of an inclination in the center axis of the first pipe portion around a center axis of the cooling device, when the vehicle is inclined;

"$\gamma$" is an angle between a center of the communication passage and the vertical direction; and each of the angles "$\alpha$", "$\beta$" and "$\gamma$" is measured on a plane perpendicular to the center axis of the cooling device in a condition that the cooling device is installed in the vehicle, and wherein the vertical direction corresponds to the gravity direction which is set at an angle of "0° (zero degree)".

9. The cooling device according to claim 8, wherein the communication passage is formed in the cylindrical component, which is rotatable relative to the first pipe portion and the second pipe portion when the cylindrical component is assembled in the cooling device.

10. The cooling device according to claim 8, wherein the cylindrical partitioning unit is rotatable relative to the outer jacket when the cylindrical partitioning unit is assembled to the outer jacket, and the communication passage is formed in the cylindrical partitioning unit.

11. The cooling device according to claim 8, further comprising;

an inner jacket provided at the outside of the injection valve, wherein the annular space is formed between the inner jacket and the outer jacket, and the cylindrical partitioning unit is rotatable relative to the inner jacket and the outer jacket, when the cylindrical partitioning unit is assembled to the inner jacket and the outer jacket.

12. The cooling device according to claim 8, wherein the communication passage is formed in the cylindrical component at a position, which is higher than a solenoid of the injection valve in the vertical direction.

13. The cooling device according to claim 8, wherein the communication passage is formed in the cylindrical component at a position, which is higher than a solenoid of the injection valve in the vertical direction, in a condition that the cooling device is installed in the vehicle.

14. The cooling device according to claim 8, wherein the communication passage is formed in the cylindrical partitioning unit, and a length of the communication passage in a circumferential direction of the cylindrical partitioning unit is larger than a length of the communication passage in an axial direction of the cylindrical partitioning unit.

15. A cooling device for cooling down an injection valve installed in a vehicle comprising:

an inner jacket provided at an outer periphery of the injection valve;

an outer jacket provided at an outside of the inner jacket for forming an annular space between the inner jacket and the outer jacket, so that cooling water flows through the annular space;

a cylindrical partitioning unit formed in a cylindrical shape and provided between the inner jacket and the outer jacket, the cylindrical partitioning unit divides a part of the annular space into an outside passage on a side of the outer jacket and an inside passage on a side of the inner jacket valve;

a first pipe portion connected to the outer jacket for discharging the cooling water from the annular space;

a second pipe portion connected to the outer jacket for supplying the cooling water into the annular space, wherein the first pipe portion is connected to the outer jacket at a position higher than the second pipe portion in a vertical direction;

a first restricting portion provided in the annular space at a position between the first pipe portion and the second pipe portion for restricting a flow of the cooling water between a first outside passage portion and a second outside passage portion, the first outside passage portion being a part of the outside passage on an upper side and being communicated to the first pipe portion, and the second outside passage portion being another part of the outside passage on a lower side and being communicated to the second pipe portion;

a second restricting portion provided in the annular space at a position higher than the first pipe portion in the vertical direction for restricting the flow of the cooling water between the outside passage and the inside passage; and a communication passage formed between an upper-side end of the cylindrical partitioning unit and an inner wall surface of an upwardly expanded portion of the inner jacket, wherein the upwardly expanded portion is formed at a circumferential part of the inner jacket, and wherein the communication passage communicates the outside passage and the inside passage with each other.

* * * * *